US011408229B1

(12) United States Patent
Randall et al.

(10) Patent No.: US 11,408,229 B1
(45) Date of Patent: Aug. 9, 2022

(54) EXTENDIBLE WHIPSTOCK, AND METHOD FOR INCREASING THE BEND RADIUS OF A HYDRAULIC JETTING HOSE DOWNHOLE

(71) Applicant: Coiled Tubing Specialties, LLC, Tulsa, OK (US)

(72) Inventors: Bruce L. Randall, Tulsa, OK (US); Bradford G. Randall, Tulsa, OK (US)

(73) Assignee: COILED TUBING SPECIALTIES, LLC, Tulsa, OK (US)

( * ) Notice: Subject to any disclaimer, the term of this patent is extended or adjusted under 35 U.S.C. 154(b) by 132 days.

(21) Appl. No.: 16/893,947

(22) Filed: Jun. 5, 2020

Related U.S. Application Data

(60) Provisional application No. 63/000,969, filed on Mar. 27, 2020.

(51) Int. Cl.

| | |
|---|---|
| ***E21B 7/18*** | (2006.01) |
| ***E21B 7/06*** | (2006.01) |
| ***E21B 29/00*** | (2006.01) |
| ***E21B 29/06*** | (2006.01) |
| ***E21B 43/26*** | (2006.01) |

(52) U.S. Cl.
CPC ..... *E21B 7/18* (2013.01); *E21B 7/061* (2013.01); *E21B 29/002* (2013.01); *E21B 29/06* (2013.01); *E21B 43/26* (2013.01)

(58) Field of Classification Search
CPC ..... E21B 7/18; E21B 7/061; E21B 29/002; E21B 29/06; E21B 43/26
See application file for complete search history.

(56) References Cited

U.S. PATENT DOCUMENTS 3,191,697 A * 6/1965 Haines ..... C09K 8/72 175/81
4,085,808 A 4/1978 Kling
(Continued)

FOREIGN PATENT DOCUMENTS

CN 101660391 8/2008

OTHER PUBLICATIONS

S.D. Joshi, A Review of Horizontal Well and Drainhole Technology, SPE Paper No. 16,868; presented at the 62nd Annual Technical Conference (Sep. 1987).

(Continued)

*Primary Examiner* — Jonathan Malikasim
(74) *Attorney, Agent, or Firm* — Dennis D. Brown; Brown Patent Law, P.L.L.C.

(57) ABSTRACT

An apparatus and downhole method for dynamically establishing in situ an arcuate path of up to 90° or more for a jetting hose or other flexible conduit for forming a lateral bore. The apparatus includes a whipstock comprised of one or more arcuate, telescoping segments which enable the operator to avoid the friction pressure and HHP restrictions of smaller diameter hoses, imposed due to the minimum bend radius restrictions encountered when forming the bend radius solely inside the casing of a wellbore. The apparatus can also be used with a Custom Ported Casing Collar. The hose bending path is established immediately behind the jetting nozzle as the lateral borehole is excavated. Upon retrieval of the flexible conduit and excavation device, the arced extension retracts back into the whipstock body, so as not to impede the whipstock's reorientation and/or depth relocation for forming the next mini-lateral.

41 Claims, 27 Drawing Sheets

(56) References Cited

U.S. PATENT DOCUMENTS

| | | | | |
|---|---|---|---|---|
| 4,256,179 | A | 3/1981 | Shillander | |
| 5,291,975 | A | 3/1994 | Johnson et al. | |
| 5,413,184 | A | 5/1995 | Landers | |
| 5,419,405 | A | 5/1995 | Patton | |
| 5,853,056 | A | 12/1998 | Landers | |
| 5,954,131 | A | 9/1999 | Sallwasser | |
| 6,003,606 | A | 12/1999 | Moore et al. | |
| 6,092,601 | A | 7/2000 | Gano et al. | |
| 6,125,949 | A | 10/2000 | Landers | |
| 6,263,984 | B1 | 7/2001 | Buckman, Sr. | |
| 6,283,230 | B1 | 9/2001 | Peters | |
| 6,378,629 | B1 | 4/2002 | Baird | |
| 6,412,578 | B1 | 7/2002 | Baird | |
| 6,419,020 | B1 | 7/2002 | Spingath | |
| 6,464,003 | B2 | 10/2002 | Bloom et al. | |
| 6,467,557 | B1 | 10/2002 | Krueger et al. | |
| 6,530,439 | B2 | 3/2003 | Mazorow | |
| 6,550,553 | B2 | 4/2003 | Baird | |
| 6,578,636 | B2 | 6/2003 | Mazorow et al. | |
| 6,629,568 | B2 | 10/2003 | Post | |
| 6,668,948 | B2 | 12/2003 | Buckman, Sr. et al. | |
| 6,889,781 | B2 | 5/2005 | Mazorow | |
| 6,915,853 | B2 * | 7/2005 | Bakke | E21B 7/18 166/298 |
| 6,964,303 | B2 | 11/2005 | Mazorow et al. | |
| 6,971,457 | B2 | 12/2005 | Baird | |
| 7,114,583 | B2 | 10/2006 | Chrisman | |
| 7,168,491 | B2 | 1/2007 | Malone et al. | |
| 7,185,716 | B2 | 3/2007 | Bloom et al. | |
| 7,350,577 | B2 | 4/2008 | Watson | |
| 7,357,182 | B2 * | 4/2008 | Hunt | E21B 7/18 166/298 |
| 7,422,059 | B2 | 9/2008 | Jelsma | |
| 7,441,595 | B2 | 10/2008 | Jelsma | |
| 7,445,127 | B2 | 11/2008 | Schick | |
| 7,540,327 | B2 | 6/2009 | Billingham | |
| 7,669,672 | B2 | 3/2010 | Brunet et al. | |
| 7,686,101 | B2 | 3/2010 | Belew et al. | |
| 7,699,107 | B2 | 4/2010 | Butler et al. | |
| 7,886,834 | B2 | 2/2011 | Spencer et al. | |
| 7,971,658 | B2 | 7/2011 | Buckman, Sr. | |
| 8,028,766 | B2 | 10/2011 | Moore | |
| 8,074,744 | B2 * | 12/2011 | Watson | E21B 43/305 175/67 |
| 8,196,680 | B2 | 6/2012 | Buckman, Sr. et al. | |
| 8,245,788 | B2 | 8/2012 | Garcia et al. | |
| 8,245,796 | B2 | 8/2012 | Mock | |
| 8,267,198 | B2 | 9/2012 | Buckman, Sr. et al. | |
| 8,267,199 | B2 | 9/2012 | Buckman, Sr. et al. | |
| 8,307,902 | B2 | 11/2012 | Telfer | |
| 8,327,746 | B2 | 12/2012 | Behrmann et al. | |
| 8,752,651 | B2 | 6/2014 | Randall et al. | |
| 8,833,444 | B2 | 9/2014 | McAfee et al. | |
| 8,844,636 | B2 | 9/2014 | Bebak et al. | |
| 8,991,522 | B2 | 3/2015 | Randall et al. | |
| 9,080,388 | B2 | 7/2015 | Heignen | |
| 9,080,413 | B2 | 7/2015 | Winnon | |
| 9,267,338 | B1 | 2/2016 | LeBlanc et al. | |
| 9,284,816 | B2 | 3/2016 | Radford | |
| 9,856,700 | B2 | 1/2018 | Zheng et al. | |
| 9,976,351 | B2 | 5/2018 | Randall | |
| 9,988,900 | B2 | 6/2018 | Kampfer et al. | |
| 10,113,393 | B2 | 10/2018 | Saponja et al. | |
| 10,132,154 | B2 | 11/2018 | Witte et al. | |
| 10,151,172 | B1 | 12/2018 | Dallas | |
| 10,174,573 | B2 | 1/2019 | Bakke et al. | |
| 10,174,586 | B2 | 1/2019 | Symms | |
| 10,174,595 | B2 | 1/2019 | Knight et al. | |
| 10,215,014 | B2 | 2/2019 | Dawson et al. | |
| 10,227,825 | B2 | 3/2019 | Randall | |
| 10,227,866 | B2 | 3/2019 | Godager et al. | |
| 10,233,493 | B2 | 3/2019 | He et al. | |
| 10,240,418 | B2 | 3/2019 | Ruttley | |
| 10,309,205 | B2 | 6/2019 | Randall | |
| 2001/0045282 | A1 * | 11/2001 | Robinson | E21B 7/18 166/298 |
| 2001/0052427 | A1 | 12/2001 | Eppink et al. | |
| 2002/0062993 | A1 | 5/2002 | Billingsley | |
| 2003/0108393 | A1 | 6/2003 | Coenen | |
| 2003/0213590 | A1 | 11/2003 | Bakke et al. | |
| 2005/0173123 | A1 | 8/2005 | Lund et al. | |
| 2005/0279499 | A1 | 12/2005 | Tarvin et al. | |
| 2006/0169495 | A1 | 8/2006 | Kolle | |
| 2006/0278393 | A1 | 12/2006 | Hunt et al. | |
| 2007/0151766 | A1 | 7/2007 | Butler et al. | |
| 2008/0073077 | A1 | 3/2008 | Tunc et al. | |
| 2008/0179061 | A1 | 7/2008 | McAfee | |
| 2009/0091202 | A1 | 4/2009 | Parmeter et al. | |
| 2009/0107678 | A1 | 4/2009 | Buckman, Sr. | |
| 2010/0243266 | A1 | 9/2010 | Soby et al. | |
| 2011/0203847 | A1 | 8/2011 | Randall et al. | |
| 2011/0290561 | A1 | 12/2011 | Randall et al. | |
| 2013/0087321 | A1 | 4/2013 | Bartko | |
| 2013/0087323 | A1 | 4/2013 | Allamon et al. | |
| 2013/0284516 | A1 | 10/2013 | Prill et al. | |
| 2014/0054087 | A1 | 2/2014 | Wang et al. | |
| 2014/0102801 | A1 | 4/2014 | Hallundbaek et al. | |

OTHER PUBLICATIONS

J.H. Olsen, Abrasive Jet Mechanics, Te Fabricator Magazine (Mar. 2005 www.omax.com/images/files/abrasjvejet%20mechanics.pdf.

M. Kojic, et al., Analysis of the influence of Fluid Flow on Plasticity of Porous Rock Under an Axially Symmetric Punch, SPE Paper No. 4243 (Jun. 1974).

D.A. Summers, et al., Can Nozzle Design Be Effectively Improved for Drilling Purposes, Energy Technology Conference, Houston, Texas (Nov. 1978).

*Carl Landers and Landers Horizontal Drill Inc* v *Sideways LLC*, United States Court of Appeals for the Federal Circuit, 04-1510, -1538 (Decided Jul. 27, 2005).

Carrell et al., Report, Lateral Drilling and Completion Technologies for Shallow-Shelf Carbonates of the Red River and Ratcliffe Formations, Williston Basin (Jul. 1997).

W. Dickinson, et al., Data Acquisition Analysis and Control While Drilling With Horizontal Water Jet Drilling Systems, SPE Paper No. 90-127 (Jun. 1990).

A.W. Momber, Deformation and Fracture of Rocks Due to High Speed Liquicd Impingement, International J. of Fracture. pp. 683-704, Netherlands (Aug. 2044).

G.P. Tziallas, et al., Determination of Rock Strength and Deformability of Intact Rocks, EJGE vol. 14 (2009).

D.A. Summers, et al., Development of a Water Jet Drilling System, 4th International Symposium on Jet Cutting Technology, Canterbury, England (Apr. 1978).

D.A. Summers, Disintegration of Rock by High Pressure Jets, University of Leeds, Department of Applied Meneral Sciences, Ph.D. Dissertation (May 1968).

O. Katz, et al., Evaluation of Mechanical Rock Properties Using a Schmidt Hammer, International J. of Rock Mechanics, pp. 723-728 (2000).

D.A. Summers, Feasibility of Fluid Jet Based Drilling Methods for Drilling Through Unstable Formations, SPE Horizontal Well Technology Conference, Calgary, Alberta (Nov. 2002).

W.C. Maurer, et al., High Pressure Drilling, Journal of Petroleum Technology, pp. 851-859 (Jul. 1973).

W. Dickinson, et al., Horizontal Radial Drilling System, Society of Petroleum Engineers No. 13,949; California Regional Meeting, Bakersfield, California (Mar. 1985).

W.C. Maurer, et al., Hydraulic Jet Drilling, SPE Paper No. 2,434 (1969).

J.L. Pekarek, et al., Hydraulic Jetting: Some Theoretical and Experimental Results, SPE Paper No. 421, pp. 101-112 (Jun. 1963).

R. Kovaceviv, Hydraulic Process Parameters, SMU School of Engineering—Website Publication (accessed in 2012) http://lyle.smu.edu/.

(56) References Cited

OTHER PUBLICATIONS

D.A. Summers, et al., HyperVelocity Impact on Rock, AIME's Eleventh Symposium on Rock Mechanics, Berkely, California; Part VI—Chapter 32 (Jun. 1969).
F.C. Pittman, Investigation of Abrasive Laden Fluid Method for Perforation and Fracture Initiation, SPE Paper No. 1607-G; J. of Petroleum Technology, pp. 489-495 (May 1961).
P. Buset, A Jet Drilling Tool: Cost Effective Lateral Drilling Technology, SPE Paper No. 68,504; SPE/ICoTA Roundtable, Houston, Texas (Mar. 2001).
D.A. Summers, et al., Petroleum Applications of Emerging High Pressure Waterjet Technology, SPE Paper No. 26,347, Houston, Texas (Oct. 1993).
D.A. Summers, et al., Progress in Rock Drilling, Mechanical Engineering (Dec. 1989).
John H. Olson, Pumping Up the Waterjet Power, pp. 1-5 (Dec. 2007).
D.A. Summers, Recent Advances in the Use of High Pressure Waterjets in Drilling Applications, Advance Mining Technology Workshop, Colorado School of Mines (Oct. 1995).
R. Feenstra, et al., Rock Cutting by Jets a Promising Method of Oil Well Drilling, SPE Paper No. 4,923 (Sep. 1973).
W. Dickinson, et al., Slim Hole Multiple Radials Drilled with Coiled Tubing, SPE Paper No. 23,639; 2nd Latin American Petroleum Engineering Conference, Venzuela (Mar. 1992).
Smith Services, A Business Unit of Smith International, Inc., Smith International Inc. Trackmaster PLUS Wellbore Departure Systems, Houston, Texas (Apr. 2005).
D.A. Summers, The Application of Waterjets in a Stressed Rock Environment, Third Conference on Ground COntrol Problems in the Illinois Coal Basin (Aug. 1990).
P.C. Hagan, et al., The Cuttability of Rock Using a High Pressure Water Jet, School of Mining Engineering, The University of New South Wales (1990).
D.A. Summers, et al., The Effect of Change in Energy and Momentum Levels on the Rock Removal in Indiana Limestone, Symposium on Jet Cutting Technology, England (Apr. 1972).
D.A. Summers, et al., The Effect of Stress on Waterjet Performance, 19th Symposium on Rock Mechanics, Lake Tahoe, Nevada (May 1978).
D.A. Summers, et al., The Penetration of Rock by High Speed Water Jets, Int. J. Rock Mech. Min. Sci. vol. 6, pp. 249-258 Pergamon Press (1969).
U.S. Hose Corp., U.S. Hose Corporation Engineering Guide No. 350, Technical Specifications for U.S. Hose's Flexible Hoses, Romeoville, Illinois and Houston, Texas (2006).
D.A. Summers, et al., Water Jet Cutting of Sedimentary Rock, J. of Petroleum Technology, pp. 797-802 (Jul. 1972).
D.A. Summers, Water Jet Cutting Related to Jet and Rock Properties, 14th Symposium of Rock Mechanics, Penn State University, University Park, Pennsylvania (Jun. 1972).
D.A. Summers, et al., Water Jet Penetration into Rock (Nov. 1970).
D.A. Summers, Waterjet Applications Session Review, 5th Pacific Rim International Conference on Water Jet Technology, New Delhi, India (Feb. 1998).
Well Enhancement Services, LLC, Radial Jet Enhancement Brochure, The Woodlands, Texas (Jun. 2009).
Well Enhancement Services, LLC, Radial Jet Enhancement Brochure, The Woodlands, Texas (Jun. 2009) www.wellenhancement.com.
Halliburton, Hydra Jet Perforating Process Service (4-page brochure setting forth the Hydra-Jet Perforating Process Service (Sep. 2006) www.hlliburton.com.
TIW Corporation, Abrasive Jet Horizontal Drill, A Pearce Industries Company located in Houston, Texas; procedures for the TIW Abrasive Jet Horizontal Drill.
Vortech Oilfield Tools, LP, Vortech Oilfield Tools, www.Vortech-Inc.com; located in Midland, Texas; questions and answers about Vortech tools (publication date unknown).
S.J. Leach, et al., Application of High Speed Liquid Jets to Cutting; vol. 260, plate 60 (1996).
W.C. Cooley, Correlation of Data on Erosion and Breakage of Rock by High Pressure Water Jets; The 12th U.S. Symposium on Rock Mechanics, Missouri (Nov. 1970).
T.J. Labus, Energy Requirements for Rock Penetration by Water Jets; 3rd Int. Symposium on Jet Cutting Technology, BHRA Fluid Engineering, Cranfield, Bedford, England (1976).
D.A. Summers, et al., Water Jet Drilling in Sandstone and Granite; Proceedings from the 18th Symposium on Rock Mechanics, Keystone, Colorado (May 1997).
G.Rehbinder, A Theory About Cutting Rock With a Water Jet; J. of Rock Mechanics and Rock Engineering, vol. 12/3-4, (Mar. 1980).
W.C. Maurer, Advanced Drilling Techniques, pp. 229-301; Petroleum Publishing Company (1980).
M. Hashish, Experimental Studies of Cutting with Abrasive Waterjets; 2nd U.S. Waterjet Conference, University of Missouri-Rolla (May 1983).
L.M. Ford, Waterjet Assisted Mining Tools What Type Assistance and What Type Mining Machine?, Energy Citations Database (1983); Abstract Only.
J.J. Koelee, A Comparison of Water Jet Abrasive Jet and Rotary Diamond Drilling in Hard Rock; Tempress Technologies, Oil and Gas Journal, vol. 96 (1999).
A.W. Momber, et al., An Energy Balance of High Speed Abrasive Water Jet Erosion; Institution of Mechnical Enineers, vol. 213 Part J; pp. 463-473 (Dec. 1998).
H. Orbanic, et al., An Instrument for Measuring Abrasive WaterJet Diameter; International J. of Machine Tools & Manufacture, #49; pp. 843-849 (May 2009).
D.A. Summers, et al., Abrasive Jet Drilling: A New Technology; 30th U.S. Symposium on Rock Mechanics, Morgantown, West Virginia (Jun. 1989).
Michael J. Mayerhofer, SRV Proves Key in Shales for Correlating Stimulation and Well Performance; Oil & Gas Reporter, pp. 81-89 (Dec. 2010).
Buckman Jet Drilling presentation, ICoTA Lunch, Houston, Texas (Aug. 2013).
W. Dickinson, et al., Coiled-Tubing Radials Placed by Water-Jet Drilling, SPE Paper No. 26,348, Houston, Texas (Oct. 1993).
International Search Report and Written Opinion for PCT/US2016/015771 dated Jun. 3, 2016.
PCT International Application PCT/US2018/0596987, Publication No. WO 2019083922, Published May 9, 2019.
D.A. Summers et al., Comparison of Methods Available for the Determination of Surface Energy, 12th Symposium or Rock Mechanics, Univ. of Missouri-Rolla (Nov. 1970).
PCT International Application PCT/US2008/080631, Publication No. WO 2009/055381, Published Apr. 30, 2009.

* cited by examiner

--Prior Art--

--Prior Art--

--Prior Art--

FIG. 2B.1

--Prior Art--

--Prior Art--

FIG. 3B.1

EXTENDIBLE WHIPSTOCK, AND METHOD FOR INCREASING THE BEND RADIUS OF A HYDRAULIC JETTING HOSE DOWNHOLE

STATEMENT OF RELATED APPLICATIONS

This application claims the benefit of U.S. Provisional Application Ser. No. 63/000,969 filed on Mar. 27, 2020 and incorporates said provisional application by reference into this document as if fully set out at this point.

FIELD OF THE INVENTION

The present invention relates to the field of well completion. More particularly, the present invention relates to apparatuses and methods for the completion and stimulation of hydrocarbon-producing or other formations by the generation of smaller diameter boreholes from a parent or main borehole by hydraulic jetting, drilling or other excavation techniques.

BACKGROUND OF THE INVENTION

This section is intended to introduce selected aspects of the art, which may be associated with various embodiments of the present disclosure. This discussion is believed to assist in providing a framework to facilitate a better understanding of particular aspects of the present disclosure. Accordingly, it should be understood that this section should be read in this light, and not necessarily as admissions of prior art.

DISCUSSION OF TECHNOLOGY

In the downhole hydraulic jetting of small diameter boreholes radially outward from a parent (cased . . . or more usually, cased and cemented) wellbore or (openhole) borehole, a downhole deviation device is commonly utilized. The function of such a device, which may be referred to as a "deflection shoe" or, as used herein, a "whipstock", is to direct a flexible conduit (e.g., a "jetting hose") and nozzle affixed to its distal end (combined, the "jetting assembly") along a desired azimuth. In most downhole hydraulic jetting systems, the jetting assembly is run into the wellbore in a generally elongated state, such that its longitudinal axis is generally the same as the host wellbore's. Thus, to generate a new, small diameter borehole (e.g., a "mini-lateral borehole" or Ultra Deep Perforation, "UDP") radially outward from the parent wellbore, it is required to turn the jetting assembly from a direction beginning generally longitudinal to the parent wellbore towards the final, desired (new) longitudinal axis for the jetting assembly that extends on out into the targeted formation. Typically, this new desired azimuth for the jetting nozzle and hose is generally perpendicular to the longitudinal axis of the wellbore . . . regardless of whether the host wellbore is vertical or horizontal. Note, it is the latter (horizontal) wellbore orientation that comprises approximately 90% of all wells currently being drilled in the domestic U.S., and essentially all wells designed for completion in unconventional (especially shale) reservoirs.

As cited in the precedent works, in a cased wellbore situation, the whipstocks described therein provide an arcuate path for the jetting assembly that utilizes the entire casing inner diameter for the jetting assembly to make its turn. Generally, this can be from a trajectory starting parallel to the longitudinal axis of the parent wellbore and ending, at the portal from which the jetting assembly exits the whipstock, at a trajectory generally perpendicular to the wellbore.

Thus, at the point of a desired casing exit, for the jetting nozzle to be oriented at the desired exit trajectory, the arc length followed by the jetting assembly has heretofore been almost entirely confined within the body of the whipstock itself. And, because the body of the whipstock must be translatable up and down the inner confines of the casing, said available arc length has thereby been proportionally limited by the inner diameter of the casing.

Depending on the convention, the rated "minimum bend radius" ("MBR") of a high pressure hydraulic hose can be measured to the centerline of the hose, or to its inside edge. The latter is probably the most popular, while the former is more often found in the context of bending tubulars. For discussion purposes herein, the minimum bend radius of a jetting hose will be defined as: " . . . the smallest diameter that a looped hose can achieve without damage and is measured as the distance to the inside edge of the hose (not the center line) when making a 90-degree bend." [https://www.crossco.com/resources/technical-bulletins-guides/bend-radius-in-hydraulic-hose/] Note this definition presumes the 90-degree bend is occurring in a single plane. In general, as regards the construction of high pressure hoses, the higher the permissible operating pressure, the more layers of reinforcement are required. This causes the hose's minimum bend radius rating to be proportionately higher . . . that is, the arc radius required to bend the hose 90° is generally larger as the hose's working and burst pressure ratings (and the commensurate number of pressure reinforcement layers) increases.

The importance of this relationship to well completions utilizing radial hydraulic jetting ("RHJ") cannot be overstated. The ability to bore rock with a hydraulic fluid or slurry . . . and to achieve a cost-effective penetration rate . . . is entirely dependent upon the specific energy ("SE") and thus the hydraulic horsepower ("HHP") deliverable to the jetting nozzle. The higher the rate and pressure of the slurry (and thus the deliverable HHP) as it exits the nozzle, the better the result. (That is, assuming the slurry's impact pressure upon the target rock face is at least greater than the rock's threshold pressure, $P_{TH}$, only above which can any erosional boring take place.) Hence, the difference in being able to commercially apply RHJ in the completion of a given formation, versus not being able to, may very well come down to the diameter and pressure rating of the applicable jetting hose.

The importance of maximizing the jetting hose I.D. for a given hydraulic jetting operation cannot be over emphasized. The Darcy equation for the pressure drop of liquid flow in a horizontal pipe.

(Source: https://petrowiki.org/Pressure_drop_evaluation_along_pipelines#General_equation) is:

$$\Delta P = \frac{.0013 \cdot f \cdot \rho \cdot L \cdot V^2}{d} \qquad \text{[Equation 1]}$$

. . . where, f=Moody friction factor (dimensionless); and L=pipe length, ft; and V=velocity, ft/sec; and ΔP=pressure drop, psi: and ρ=density, lbm/ft3; and d=pipe inside diameter, in. A simple rearrangement of this equation and a substitution of the liquid flow rate. $Q_l$ (in barrels per day) for the velocity, V, reveals for a fluid of specific gravity (SG) . . .

$$\Delta P = \frac{(11.5 \cdot 10^{-6}) \cdot f \cdot L \cdot Q_l^2 \cdot (SG)}{d^5} \quad \text{[Equation 2]}$$

that the pressure drop due to friction is inversely proportional to the I.D. of the conduit to the fifth power.

Note the determination of the applicable Moody friction factor, f, in Equations 1 and 2 is somewhat complex, in that it is empirically derived as a function of both: (1) the relative roughness of the interior surface of the fluid conduit, (∈/d), where ∈ is the absolute roughness of the interior conduit surface and d is again the interior diameter; and, (2) the flow regime of the fluid (laminar, turbulent, or intermediate). The latter is quantified by determination of the applicable Reynolds number, Re, a dimensionless parameter that characterizes the degree of turbulence in the flow regime. For a single-phase liquid, the Reynolds number is determined as . . .

$$Re = \frac{(92.1) \cdot (SG) \cdot Q_l}{d \cdot \mu} \quad \text{[Equation 3]}$$

. . . where μ=viscosity, in centipoise; and d=pipe inside diameter, inches; and (SG)=specific gravity of liquid relative to water (water=1); and $Q_l$=liquid-flow rate, Barrels/Day. In the simplest case of laminar flow (Re<2,000) there is little mixing of the liquid as it flows through the conduit, thus presenting an essentially parabolic velocity profile. The Moody friction factor determination is then rather straightforward: f=64/Re. Note determination of the relative roughness, (∈/d), is not needed here. For turbulent flow (Re>4,000) complete mixing of the flowing fluid occurs, thus presenting a uniform velocity profile. In this case calculation of the Moody friction factor, f, is arrived at by first obtaining the empirically determined absolute roughness, ∈, which is in units of length. Values of ∈, observed from lab experiments and published for various materials, are readily available. For example, carbon steel has an absolute roughness of 0.00015 feet, fiberglass epoxy an absolute roughness of 0.000025 feet, thermoplastics and drawn tubing 0.000005 feet. Note this later value would include Teflon. PTFE and PFA-PTFE, and would thus apply to many jetting hoses. Once the relative roughness of the interior surface of the fluid conduit, (∈/d) is obtained, then a Moody friction factor chart can be entered, or computer algorithm employed, to yield the Moody friction factor, f. Fortunately jetting hose manufacturers provide automated versions of the above exercise, such as Gates' https://www.gates.com/us/en/resources/calculators/fluid-flow-pressure-calculator. This simulator has been utilized to construct FIGS. 6 thru 9 for the simple case of water flow at ambient conditions through various I.D.'s of jetting hoses. Each jetting hose is 300 feet long, extended horizontally (i.e., no head losses or gains due to change in elevation) as it would be toward the end of jetting a 300' long Ultra Deep Perforation ("UDP"). Again, the exercise here is provided to reinforce just how crucial jetting hose I.D. is to provision of a maximum destructive force, here measured in hydraulic horsepower ("HHP") for the erosional boring of rock with a jetting nozzle.

FIG. 6 is a presentation of Pressure Losses (in pounds per square inch, psi) sustained in a 300 foot jetting hose at various Pump Rates (in gallons per minute, gpm). Note particularly the ordinate (Pressure) scale is logarithmic, the abscissa (Pump Rate) scale is linear . . . i.e., with linear increments in throughput, we are dealing with exponential increases in pressure losses. Jetting hoses with I.D.'s of ¼$^{ths}$-inch, ⅜$^{ths}$-inch, ½-inch, ⅝$^{ths}$-inch, and ¾$^{ths}$-inch are examined at pump rates ranging from 10.5 gpm (¼ barrels per minute, bpm) to 84 gpm (2 bpm). Almost all points on the graph represent turbulent flow. Note the dashed line provided at 15,000 psi . . . a common maximum operating pressure of coiled tubing. For a ¼-inch I.D. jetting hose, such an operating limit would yield approximately 12 gpm . . . or not much more than ¼ bpm. That is, at only 12 gpm, a ¼-inch I.D. jetting hose would consume the entirety of a 15 k psi limit with its own friction pressure losses. Similarly, a ⅜$^{ths}$-inch I.D. hose would consume the 15 k psi limit at 37 gpm, the ½-inch hose at 80 gpm . . . i.e., at a 15 k psi pressure limit, a simple ⅛$^{ths}$-inch difference in jetting hose I.D. (from ⅜$^{ths}$-inch to ½ inch) more than doubles the throughput. The calculations, which utilize the jetting hose manufacturer Gates' hydraulic simulator (https://www.gates.com/us/en/resources/calculators/fluid-flow-pressure-calculator), assume a constant length of 300 feet for each hose, and a jetting fluid of water at ambient conditions.

It comes as no surprise then, that when the ordinate of FIG. 6 (Pressure Loss) is converted to hydraulic horsepower ("HHP") to yield FIG. 7, we once again see linear increments in throughput yielding exponential increases in (HHP) losses. Note both sets of curves are plotted simultaneously in FIG. 8, with results of curve fitting algorithms posted for each, with Pressure Losses on the left hand ordinate, HHP Losses on the right. Both sets of curve fits yield highly accurate predictive results, with ΔP-vs-$Q_l$ producing an $R^2$ range of 0.9997 to 1.0000, and ΔHHP-vs-$Q_1$ even more accurate at an $R^2$ range of 0.9999 to 1.0000 (with an $R^2$=1.0000 indicating a perfect fit). Note also from both relationships depicted in FIG. 8, ΔP-vs-$Q_l$ and ΔHHP-vs-$Q_l$, the form of each is the same:

$$Y = (\text{Coefficient}) \cdot X^{(Exponent)} \quad \text{[Equation 4]}$$

For each of the jetting hose I.D.'s represented in FIG. 8, FIG. 9 presents a combined plot of their respective ΔP and ΔHHP Exponents (left hand ordinate, linear scale) and Coefficients (right hand ordinate, logarithmic scale). Here we see, again with relatively high correspondences of $R^2$, Exponents governing each hose I.D.'s Pressure-vs-Pump Rate relationship vary between 1.9936 to 1.8554, and similarly Exponents governing each hose I.D.'s HHP-vs-Pump Rate relationship vary between 2.9335 to 2.8554. That is, as a jetting fluid (in liquid phase) is delivered through the jetting hose to the jetting nozzle, losses of Pressure versus increasing pump rate are roughly an exponentially squared function, whereas losses of HHP are essentially an exponentially cubed function. Lastly, note the corresponding relationships of the Coefficients of these functions, with their respective logarithmic ordinate scale shown on the right hand side of FIG. 9. That is, the Coefficients themselves of Equation 3, for both Pressure and HHP losses versus Pump Rate, decrease exponentially with increases in jetting hose I.D. The Coefficients of both the Pressure and HHP relationships drop at essentially the same exponential rate of −3.43.

In summary, for a downhole hydraulic jetting system having an operation constrained by the operating pressure of the jetting fluid . . . and particularly for one deployed on coiled tubing . . . THE most important determinant of rock destructive force deliverable to the jetting nozzle is the I.D. of the jetting hose.

Of course, for any rock penetration to occur at all, the entirety of the jetting operation must be performed at jetting nozzle discharge pressures, $P_J$'s, in excess of the rock threshold pressure, $P_{Th}$. Further, for the UDP's hole excavation to be performed within an acceptable time frame, the rate of penetration ("ROP", in feet per minute, which is the same as "$E_R$", the Erosion Rate) must be acceptable as well. A formal derivation of ROP as a function of the Specific Energy Requirement, SER, is presented in a precedent work, U.S. Pat. No. 8,752,651; "Downhole Hydraulic Jetting Assembly, and Method for Stimulating a Production Wellbore", issued Jun. 17, 2014, and is incorporated herein by reference. Equation 25 as presented therein is as follows:

$$E_R = \frac{.00007273 \times Q \times (P_J - P_{Th})^{(1/b)}}{a} \quad \text{[Equation 5]}$$

Seminal conclusions from this work are: Assuming $P_J > P_{Th}$, the achievable Erosion Rate, $E_R$, of a radial lateral being hydraulically jetted will be linearly proportional to the pump rate, Q, that can be achieved. It should be noted that, for both rocks for which hydraulic drilling penetration (e.g., Power Output-vs-$E_R$) data could be compiled, (Darley Dale and Berea sandstones) b>1.0. Hence, according to Equation 4, as long as $P_J > P_{Th}$, and b>1.0, the dominant determinant of $E_R$ will not be the jetting pressure, $P_J$, but will be the pump rate, Q. Hence, the ultimate success, and eventual commerciality of any lateral borehole erosional system will be governed by how effectively and efficiently it can put the maximum hydraulic horsepower output (P.O.) at the jetting nozzle, and specifically, by how well it can maximize the pump rate, Q, at jetting pressures $P_J$ greater than the threshold pressure, $P_{Th}$.

Obviously then, both of the major determinants of $E_R$, the pump rate, Q, and the jetting pressure difference above threshold at the rock face, ($P_J - P_{Th}$), benefit from the maximum jetting hose I.D. that can be employed. Recall that generally, the higher the jetting pressure, the thicker wall of jetting hose is required, regardless of whether supporting layers are spiral or braided wire, braided wire or Kevlar, etc. It is also generally true that these additional wall support requirements typically inflict a proportionally greater minimum bend radius ("MBR") requirement. Note also the greater the jetting hose's wall thickness for a desired I.D., the greater the jetting hose's O.D., and hence the greater the jetted hole (UDP's) diameter required to conduct it. Obviously, this imposes a proportionally increased excavation target area and hole excavation volume . . . precisely, to an exponentially squared power (FIG. 10). Though the benefit gained by greater jetting hose I.D. to reduced pressure losses is slightly less (an exponent of approximately 1.9), recall the benefit of increased deliverable HHP was to an exponent of approximately 2.9 . . . almost a full power higher. Hence, it is presumed that in every conceivable downhole configuration having a cased hole completion, the optimum jetting parameters will be driven by the maximum jetting hose I.D. that can satisfy the working pressure, temperature, and MBR requirements.

Obviously, at downhole conditions, the governing issue here is one of confinement. For a cased wellbore, the precedent works cited herein note the advancement of being able to utilize the entire inner diameter of the casing for the jetting hose to make its requisite bend. This is significant, in that the availability to accommodate, say, just an additional half-inch for the bend radius of a given jetting hose may be the difference in being able to utilize the next higher I.D. and/or pressure rating of jetting hose. This newfound ability to "upsize" the jetting hose for a given formation may be the difference in being able to commercially apply RHJ, or not.

Critical to this process is delivery of the jetting slurry at flow rates and pressures (specifically, above the formation's Threshold Pressure, "$P_{Th}$") that can provide adequate hydraulic horsepower ("HHP"), and thus Specific Energy ("SE") to the jetting nozzle for economic generation of UDP's in a given pay zone. Typically the constraints that limit these crucial deliveries are found entirely within the jetting hose; e.g., its inner diameter ("I.D.") and working pressure ("WP") . . . both of which being key determinants of the jetting hose's minimum bend radius ("MBR") requirement. Generally, due to the materials and methods of hose construction, these are always positively correlated: the larger the I.D. and WP requirements. the larger the MBR necessary to bend the jetting hose to its desired azimuth. Heretofore, the upper limit of an acceptable MBR has been dictated by the I.D. of the wellbore's casing or the (open-hole) borehole.

Ideally speaking, one would like to deliver all of the HHP generated by the high pressure surface pumps, plus any vertical head gain from subsurface depth, directly to the jetting nozzle. Practically, however, system losses preclude such an ideal delivery. In most RHJ systems, the greatest loss is due to friction forces imposed on the jetting fluid by the I.D. of the jetting hose. Hence, the largest I.D. of jetting hose is desired in order to minimize these losses, which in turn increases the O.D. of the jetting hose. Similarly. the highest possible jetting pressure is desired at the jetting nozzle. But the higher the jetting pressure, the greater the pressure rating is required of the jetting hose, and thus a proportional increase of jetting hose wall strength is incurred to withstand the burst forces. Though the choice of hose materials and type of construction can reduce hose wall thickness, generally speaking, the higher the burst resistance desired, the thicker the hose wall required. This has at least two detrimental RHJ system design effects:

First, the greater the O.D. of the jetting hose, the greater the casing exit and subsequent mini-lateral (UDP) diameters required to accommodate the larger diameter hose. Table 1, below, presents some sample calculations of the impact this

TABLE 1

Excavation Requirements for Various Hole Diameters

| Hole Dimensions | | | Hole Volume over a lateral length of. . . | | | Total Weight of Excavated Material from Lateral Borehole for Specific Gravity of shale at. . . | | | | |
|---|---|---|---|---|---|---|---|---|---|---|
| | | | | | | 2.4 | 2.8 | g/cc | | |
| | | | | | | yeilds densities of. . . | | | | |
| | | | | | | 149.76 | 174.72 | lbm/ft$^3$ | | |
| diameter inches | radius inches | area inches$^2$ | 300 inches$^3$ | feet feet$^3$ | -times- 62.4 | and pounds of shale excavated per Lateral. . . | | -div by- 2000 | and tons of shale excavated per Lateral. . . | |
| 7.875 | 3.94 | 48.71 | 175,345 | 101.47 | | 15,197 | 17,729 | | 7.60 | 8.86 |
| 2.56 | 1.28 | 5.15 | 18,530 | 10.72 | | 1,606 | 1,874 | | 0.80 | 0.94 |
| 1.50 | 0.75 | 1.77 | 6,362 | 3.68 | | 551 | 643 | | 0.28 | 0.32 |

increase in hole diameter has on the excavation requirement:

Compare, for example, the last two lines of Table 1. To increase the mini-lateral's diameter from 1.50 inches to 2.56 inches is roughly just over two-thirds (70.7%) of an increase. However, say for a 300 foot UDP length, this same two-thirds diameter increase mandates an almost three-told (291%) increase in the rock volume excavation requirement.

Secondly, the higher pressure-rated (and greater wall strength and, generally, greater wall thickness) hoses also have a proportionally larger bend radius requirement. Granted, the selection of strength reinforcement materials and their configuration (spiral wire, braided wire, braided Kevlar®, etc.) greatly influences the pressure rating of a given jetting hose. Notwithstanding, a higher desired pressure rating, generally drives a greater number of reinforcing layers required to support burst forces in the hose's core, with the minimum bend radius requirement generally increasing proportionately, too.

Hence, RHJ system design optimization involves: (1) optimizing the mini-lateral's diameter (and hence, the requisite volume of casing, cement, and rock to be excavated) while concurrently maximizing the penetration rate by which the mini-lateral can be jetted; and thus, (2) maximizing HHP and SE delivery to the jetting nozzle; while, (3) accommodating the confinement of the cased wellbore and the RHJ tool string, and specifically their constraints imposed on the jetting hose's MBR. All of these three factors are direct drivers in the selection process of an appropriate jetting hose for a given RHJ application. Specifically, #1 and #3 benefit from a smaller diameter(s) jetting hose, while #2 benefits from a larger hose I.D. In almost all cases, it is the confinement limitations of #3 that impose a detrimental reduction in the bend radius available for the jetting hose to make its requisite turn. This commensurately sacrifices the delivery of the desired HHP and SE in #2, thus yielding sub-optimum UDP mini-lateral diameters and/or penetration rates (#1)

Thus, what is needed is an apparatus and method of dynamically growing and forming the arcuate path for the bending of the jetting hose, and to be able to do so (at least partially) outside the constraints of the wellbore's I.D. That is, whereby the initial, curved portion of the UDP's trajectory is no longer limited to the I.D. of the wellbore itself . . . or more specifically, to the static pathway provided by a diversion tool (diverter shoe or whipstock) that must function within said wellbore's I.D. Dynamic formation of the arcuate UDP path would mean that, while hydraulically boring through the casing, then cement, and finally the near-wellbore formation (the combination of these three borings comprising the initial, curved segment of the UDP) the arcuate bending path of the jetting hose is simultaneously formed and established. Also it is desired that, upon its full extension, such an extendible whipstock's sleeve fully appends the arcuate bending path for the jetting hose initiated within the body of the whipstock itself. Thus, these two curved segments of the hose path (both the in- and ex-whipstock portions) would preferably combine to direct the jetting assembly arcuately to its target azimuth relative to the longitudinal axis of the wellbore. In addition, it is desired that even while fully extended, the sleeve has sufficient length such that its proximal end will always reside within, and be stabilized by, the rigid body of the whipstock. Conversely, it is desired that the segment(s) comprising this apparatus are short enough such that they are fully retractable within the body of the whipstock. Thus, the telescoping segment(s) comprising the sleeve would not be damaged while, nor impede, translating the whipstock within the wellbore. Accordingly, said retraction of the telescoping segment(s) up into the body of the whipstock would preferably occur no later than the retraction of the distal end of the jetting assembly itself (that is, the jetting nozzle). And lastly, it is desired that the wall body thickness(es) of the segment(s) comprising the sleeve would not impose a detrimental increase in the requisite casing exit and mini-lateral diameters.

SUMMARY OF THE INVENTION

The present invention alleviates the problems and satisfies the needs discussed above. The systems and methods described herein have various benefits in the conducting of oil and gas well completion activities.

In one aspect, a retractable, telescoping whipstock bend radius extension is provided. The extendible whipstock and its telescoping sleeve provide an arcuate path to alter the trajectory of the jetting hose or other flexible conduit such that interference will preferably be initiated between the jetting slurry and the inner surface of the well casing (or, in an open hole application, the parent borehole wall). The ensuing jetting fluid contacts and erodes the well casing thereby permitting the creation of the small diameter borehole through the wall of the well casing. The hydraulic jetting operation then continues with the protrusion of the jetting assembly through the well casing and well cement, continuing directionally radially outward from the well casing and wellbore further into the rock formation to a pre-determined distance thereby creating an Ultra Deep Perforation (UDP). (See FIGS. 3B, 3C, and 3D.)

In another aspect, there is provided an actuatable telescoping extension, or "sleeve", from a whipstock that may be protracted upon deployment of a jetting assembly or other excavation assembly, and subsequently retracted upon retrieval of the assembly. When deployed, the inner face of the telescoping extension serves to extend the arcuate path initially defined by the inner channel of the whipstock body itself, thereby guiding the jetting assembly in a pre-determined direction relative to the longitudinal axis of the parent wellbore or borehole. Thus, the extendible whipstock enables the jetting assembly to arrive at its desired trajectory over a longer distance than otherwise achievable within the body of the whipstock itself. In contrast, without a telescoping sleeve, the whipstock body can only provide a limited arcuate path for the jetting assembly, because it is confined by the diameter of the wellbore. That is, in such a limited case, the best that can be achieved is utilizing the entire casing I.D. to construct the complete bend radius for the jetting hose, as was established by the precedent works previously cited. Hence, the telescoping sleeve overcomes this limitation, thereby decreasing the bending moment imposed at any one point in the jetting assembly, thus accommodating hoses with larger I.D.'s. WP's, and MBR requirements, with their commensurately larger deliverables of HHP and SE to the jetting nozzle.

In another aspect, there is provided an apparatus and method for actually extending the whipstock's arc, and hence its ability to accommodate the bending path of a given jetting hose or other flexible conduit of the excavation assembly, beyond the inner diameter of the parent well's casing and/or borehole. This is preferably accomplished by employing a thin walled, curved and generally cylindrical telescopic sleeve that, in running position, resides up in the body of the whipstock, and then, in operating position extends from the body of the whipstock. extends through the casing exit, into or through the cement sheath, and typically into the pay zone itself.

The sleeve will preferably have a generally curvilinear length and arc size that appends and completes the bending path of the jetting hose, or other flexible conduit, initiated within the body of the whipstock itself. The shape, and particularly the diameter and arc length, of the sleeve are such that the sleeve is fully retractable up into the body of the whipstock, so as not to present a protrusion that can hang up while running into or out of a wellbore.

The overall (arc) length of the sleeve or sleeve assembly is preferably such that the sleeve is fully retractable into the whipstock body (while in running position). The diameter(s) of the sleeve segment(s) is/are preferably larger than the outer diameter (O.D.) of the jetting hose, to accommodate the entire length of jetting hose running through it (while in operating position). Further, the sleeve preferably has an outer diameter which is generally equal to or slightly less than the O.D. of the jetting nozzle . . . and less than the I.D. of the mini-lateral borehole generated by the jetting nozzle. To fully extend and complete the arc to be provided for the requisite bending of the jetting hose, the sleeve will preferably fit through the casing exit, and will typically extend even further into the immediate portion of the mini-lateral jetted through the cement sheath surrounding the casing, and preferably even further on out into the formation rock itself. The exact span of this arcuate path will typically be determined, not by the whipstock, but by the minimum bend radius (MBR) of the jetting hose to be employed, in conjunction with the desired trajectory of the UDP in relation to the longitudinal axis of the wellbore.

For discussion purposes herein, it is generally presumed that the desired UDP trajectory is generally perpendicular to the longitudinal axis of the parent wellbore. and also generally parallel to the bedding plane of the pay zone. However, other trajectories may be desired. For example, when the longitudinal axis of the wellbore is not parallel to the least principle horizontal stress of the pay zone, yet the desired (final) trajectories of the UDP's in alignment with the maximum principle stress of the pay zone, and parallel to its bedding plane. Specifically, so the respective UDP's will be generated such that the hydraulic fractures emanating from them will be in alignment with the pay zone's maximum principal stress. In this situation, the longitudinal axis of the UDP's generated on one side of the parent wellbore would be at less than 90°, and on the opposite side of the wellbore they would be greater than 90°. This could be accomplished with the same extendible whipstock apparatus, simply by governing the distance the sleeve extends from the whipstock. Similarly, UDP trajectories not parallel to the pay zone's bedding plane could be obtained simply by rotating the extendible whipstock (prior to generating the casing exit) to the desired orientation.

In another aspect, the sleeve can be formed of multiple, concentric (when retracted) sleeve segments in order to increase the arc length for a given application. For example, in open hole application, and/or where a relatively long bending arc is required . . . say, when using an ultra-high pressure jetting hose with a relatively long MBR, a multi-segment telescoping sleeve may be needed or preferred. However, in a cased-hole environment, the more thickness added by multiple concentric segments, the larger the casing exit (and, at least in the near-wellbore region, the jetted mini-lateral's I.D.) required to accommodate them.

In another aspect, there is provided an apparatus for increasing a downhole bend radius of an arcuate bending path for a flexible conduit. The apparatus preferably comprises: (a) a whipstock body having a curved inner channel which defines a proximal portion of the arcuate bending path for the flexible conduit; (b) an arced extension for the curved inner channel of the whipstock body; (c) the arced extension being retractable to a fully retracted position in which a distal end of the arced extension is positioned within the whipstock body; and (d) the arced extension being extendible from the fully retracted position of the arced extension to a fully extended position. When the arced extension is partially extended or in the fully extended position, the arced extension defines a distal portion of the arcuate bending path for the flexible conduit. When the arced extension is in the fully extended position, a proximal end of the arced extension is positioned within the whipstock body and the distal end of the arced extension is positioned outside of the whipstock body.

This apparatus can also comprise: the arced extension including a stop structure; the stop structure of the arced extension abutting a retraction stop structure within the whipstock body when the arced extension is fully retracted; and the stop structure of the arced extension abutting an extension stop structure within the whipstock body when the arced extension is fully extended. In another aspect, the arced extension can be formed of a single arcuate sleeve segment or a plurality of telescoping arcuate sleeve segments. In another aspect, when the arced extension is fully extended, the arcuate bending path for the flexible conduit formed by the curved inner channel of the whipstock body and the arced extension can be an arc in a range of from 70° to 110°. In another aspect, when the arced extension is fully extended, the arcuate bending path for the flexible conduit formed by the curved inner channel of the whipstock body and the arced extension be an arc of about 90° (i.e., 90°±10°).

In another aspect, there is provided an apparatus for forming a lateral borehole in a subsurface formation. The apparatus preferably comprises: (a) a whipstock body having a curved inner channel; (b) an arced extension of the curved inner channel of the whipstock body, the arced extension being (i) retractable to a fully retracted position in which a distal end of the arced extension is positioned within the whipstock body and (ii) extendible along a continuum from the fully retracted position to a fully extended position in which a proximal end of the arced extension is positioned within the whipstock body and the distal end of the arced extension is positioned outside of the whipstock body; (c) a flexible conduit which slidably extends through the curved inner channel of the whipstock body and through the arced extension; and (d) an excavation device positioned on a distal end of the flexible conduit outside of the distal end of the arced extension. The curved inner channel of the whipstock body and the arced extension, when partially or fully extended, form an arcuate bending path for the flexible conduit. By way of example, but not by way of limitation, the flexible conduit can be a flexible jetting hose and the excavation device can be a jetting nozzle.

In another aspect, there is provided a method of increasing a bend radius of an arcuate bending path of a flexible conduit when forming a lateral borehole in a subsurface formation. The method preferably comprises the step (a) of positioning an excavating assembly for the lateral borehole in a cased or non-cased main borehole which extends into and/or through the subsurface formation. The excavating assembly preferably comprises: (i) a whipstock body having a curved inner channel; (ii) an arced extension of the curved inner channel of the whipstock body, the arced extension being in a retracted position in which a distal end of the arced extension is positioned within the whipstock body, (iii) a flexible conduit which slidably extends through the curved inner channel of the whipstock body and through the arced extension, and (iv) an excavation device positioned on a distal end of the flexible conduit outside of the distal end of the arced extension, the excavation device being in a retracted position in which the excavation device is positioned in the main borehole. The method preferably also comprises the steps of (b) extending the excavation device and the flexible conduit from the whipstock body, and initially extending the arced extension from the whipstock body with the excavation device and the flexible conduit so that the curved inner channel of the whipstock body and the arced extension form an arcuate bending path for the flexible conduit, wherein the arced extension is extended with the excavation device and the flexible conduit until a fully extended position of the arced extension is reached in which the arced extension extends into a cased or non-cased wall of the main borehole and, after the fully extended position of the arced extension is reached, (c) extending the excavating device and the flexible conduit from the distal end of the arced extension into the subsurface formation along a substantial linear trajectory to form the lateral borehole.

The ability of the sleeve used in the inventive apparatus to fully and repeatably retract into the Whipstock allows the ultra-deep perforation ("UDP") tool string to be repositioned within the wellbore to the next desired UDP interval or tools string setting depth, while protecting the nozzle, jetting hose and sleeve from damage during the tool string movement. Each combination of UDP's to be fracked together with a single frac stage . . . i.e., each UDP "cluster" . . . may require one or more UDP's to be created, thereby requiring one or multiple deployments of the jetting assembly and the sleeve. Multiple UDP's at a single interval or tool string setting depth in the well, may require multiple orientations of the whipstock, sleeve, and multiple deployments of the jetting nozzle and hose (the "jetting assembly") to achieve the desired relative positions for the UDP's at each interval or tool string setting. Multiple orientations are achievable by indexing the Whipstock, either within the well casing itself, or within a mateable Custom Ported Casing Collar ("CPCC"; reference U.S. Patent Application No. 2019-16/246,005, "Ported Casing Collar For Downhole Operations, And Method For Accessing A Formation", filed Jan. 11, 2019).

If used, a CPCC provides multiple openings that can receive and conduct the jetting assembly and sleeve through the well casing, such that hydraulically jetting through the well casing wall is not required. This reduces the time required to generate each UDP, thereby increasing the efficiency of the UPD-creating operation and corresponding well completion activities. In cases where CPCC's are not installed in the well casing, the tool string's whipstock can be located at any desired wellbore depth, and subsequently rotated to any desired orientation. These capabilities provide for properly spacing and orienting the UDP's relative to one another . . . particularly, to receive and conduct a given stage in a hydraulic fracture treatment. Of course, in these instances, UDP's must typically be jetted through the wellbore's casing. since a pre-existing port for the extendible whipstock sleeve and jetting assembly is not present.

As the jetting assembly advances, the jetting hose moves through the whipstock and beyond the outer surface of the whipstock toward the inner surface of the well casing. The sleeve is preferably sized and designed such that it simultaneously travels distally in sync with that portion of the jetting hose located immediately upstream of the jetting nozzle. In sequence, then, the blast region of high pressure jetting slurry immediately in front of the distal end of the jetting nozzle is building the curved portion of the UDP's mini-borehole cavity, first through the well casing wall, then secondly through the surrounding cement sheath (in the annular region between the wellbore's casing and parent borehole), and finally on out into the near-wellbore rock formation. Once the distal end of the sleeve has reached its maximum travel position in the whipstock as governed by the upset shoulder stop 3930.E arriving at the lower stop ring 3920 (FIG. 3C), the extension achieves its fully-distal position, which corresponds to the maximum arcuate path that the sleeve can provide for the jetting hose. The sleeve remains in this protracted position until the UDP is completed, and the jetting assembly is withdrawn, whereby the proximal end of the jetting nozzle shoulders against the distal end of the sleeve, retracting it back into the whipstock body (FIG. 3B).

Accordingly, the sleeve can provide a significantly larger radius of curvature for the jetting hose than that which could be provided within the body of the whipstock itself (FIGS. 2A and 2B.) This, in turn, provides for the utilization of jetting hoses having larger allowable minimum bend radius (MBR) requirements. Thus, the addition of the telescoping sleeve to the whipstock apparatus significantly reduces the bending stress that would be imparted on the jetting hose by bending it within the whipstock body alone. Lessened stresses imputed to the jetting hose in turn increases the maximum allowable inner and outer diameters of the jetting hose that can be utilized. By increasing the permissible inner diameter of the jetting hose, frictional forces created by the flow of the jetting fluid through the jetting hose are reduced.

For a typically well-designed radial hydraulic jetting system, this frictional pressure loss component (i.e., losses through the jetting hose) comprises the vast majority of the total frictional pressure loss of the entire system . . . for example, up to 90%. Thus, even small incremental gains in jetting hose I.D. can make very substantive reductions in these losses. That is, reducing hydraulic frictional forces within the jetting hose significantly increases the fluid volume throughput (or pump rate) for a given pressure drop limitation through the entire system; e.g., from the discharge of the surface pressure pumping equipment through the discharge of the jetting nozzle. In a nutshell, reducing the pressure and HHP drops through the jetting hose commensurately places that once wasted energy further downstream in the system as useful energy. Specifically, it provides for a geometric increase in hydraulic horsepower (HHP) and Specific Energy (SE) delivery to the jetting nozzle discharge, which in turn significantly increases the rate of penetration of the jetting assembly through the well casing, well cement, and rock formation. Thus, by increasing the maximum possible rate of penetration with the larger diameter jetting hose, the time required to generate the small diameter bore holes (UDP's) through the casing, well cement and rock formation is reduced, thereby increasing the overall efficiency of the hydraulic jetting operation and the economics of the corresponding oil and/or gas well completion.

Further objects, features, and advantages of the present invention will be apparent to those in the art upon examining the accompanying drawings and upon reading the Detailed Description of the Preferred Embodiments.

It should be noted that all of the following FIGS. 3A, 3B, 3C, 3D, 4, and 5 have been drawn to scale (approximately 2.5:1), so as to give a relative, visual appreciation for the magnitude of the physical extension accomplished by the sleeve. In addition, semi-circular arc paths, bend radii center points, and diameter measures have been superimposed on these drawings as visual aids for interpreting the drawings.

Figure 2A:
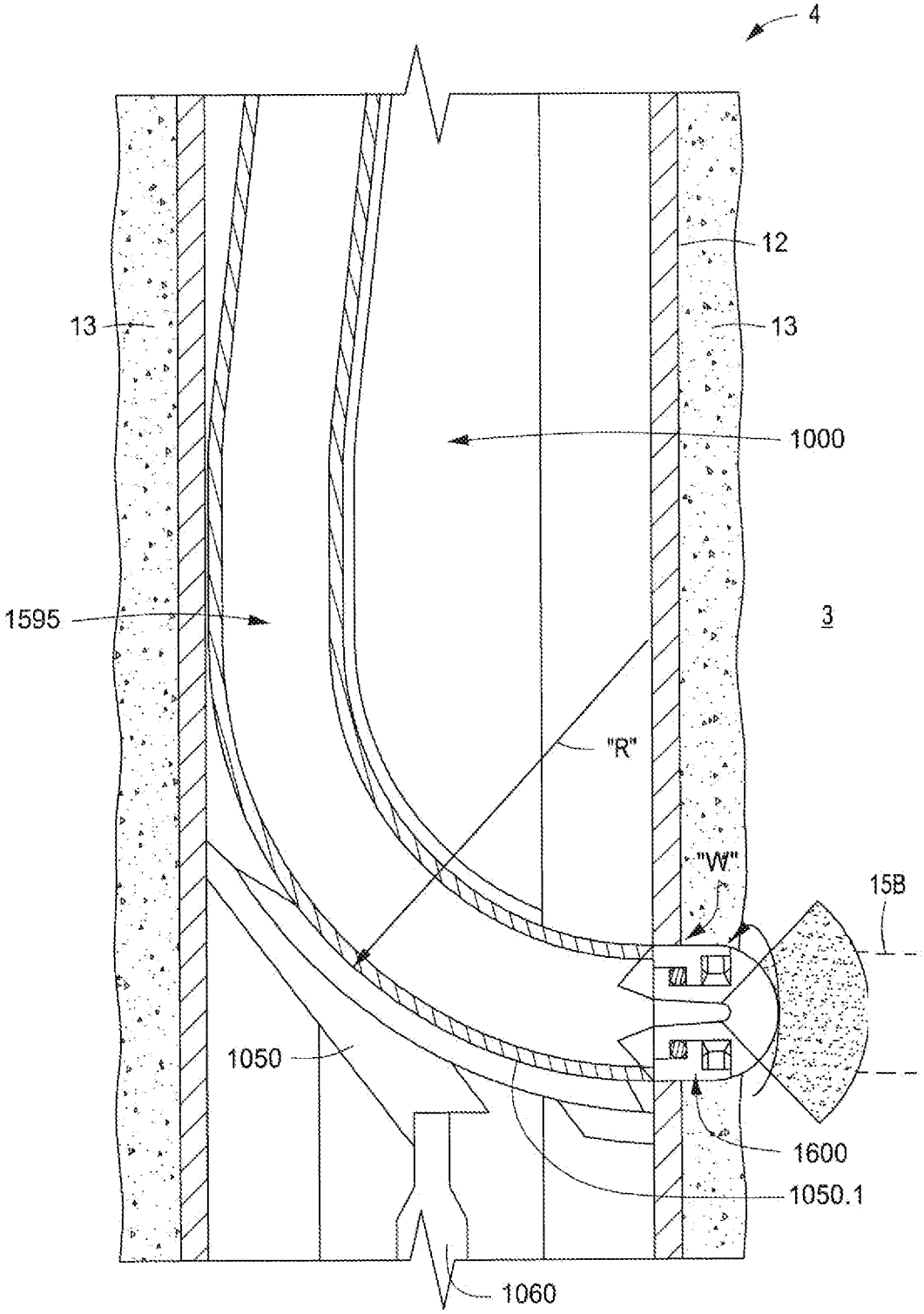
FIG. 2A provides a cross-sectional view of an ordinary whipstock device in a cased and cemented wellbore 4 having been completed in a horizontal orientation. It can be seen that the whipstock is positioned inside the casing, which is surrounded by cement, outboard of which exists the subsurface formation 3, which represents a "pay zone" for the oil and gas operator. The whipstock has a ramp with an arcuate surface upon which the jetting assembly (comprised of a jetting hose and jetting nozzle) is traversed.
Figure 2B:
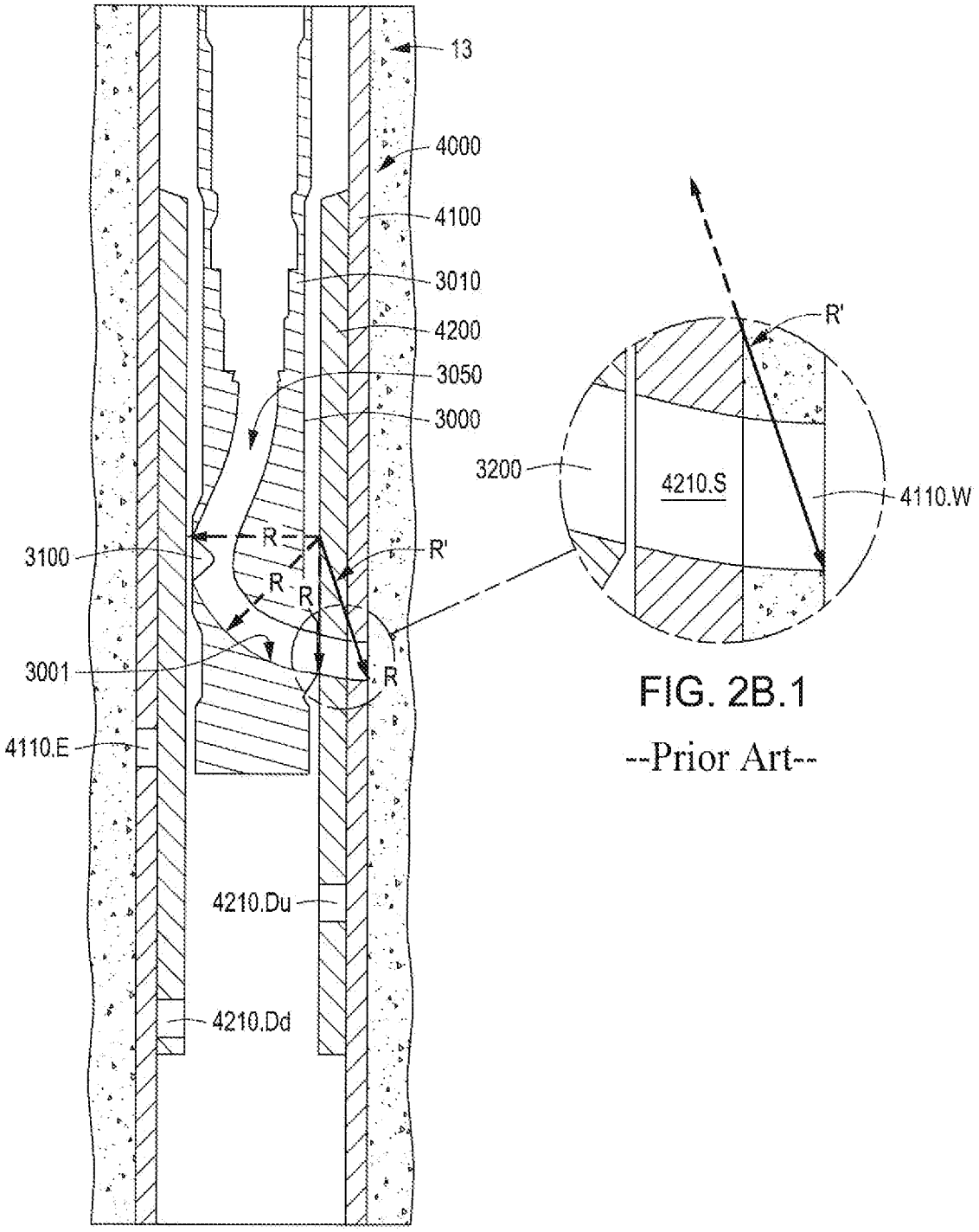
FIGS. 2B and 2B.1 provide cross-sectional views of a modified whipstock device that has been enhanced so it can mateably attach to, and manipulate the inner sleeve of a Custom Ported Casing Collar ("CPCC"). A translational force on the modified whipstock has moved the inner sleeve such that one of its ports is now aligned with a port in the stationary (cemented) outer sleeve of the CPCC. The result is to provide an arcuate path within the whipstock having an inner face upon which to translate the jetting assembly (not shown), thus providing an arc radius "R'", which is slightly larger than R provided by the conventional whipstock in FIG. 2A.
Figure 3A:
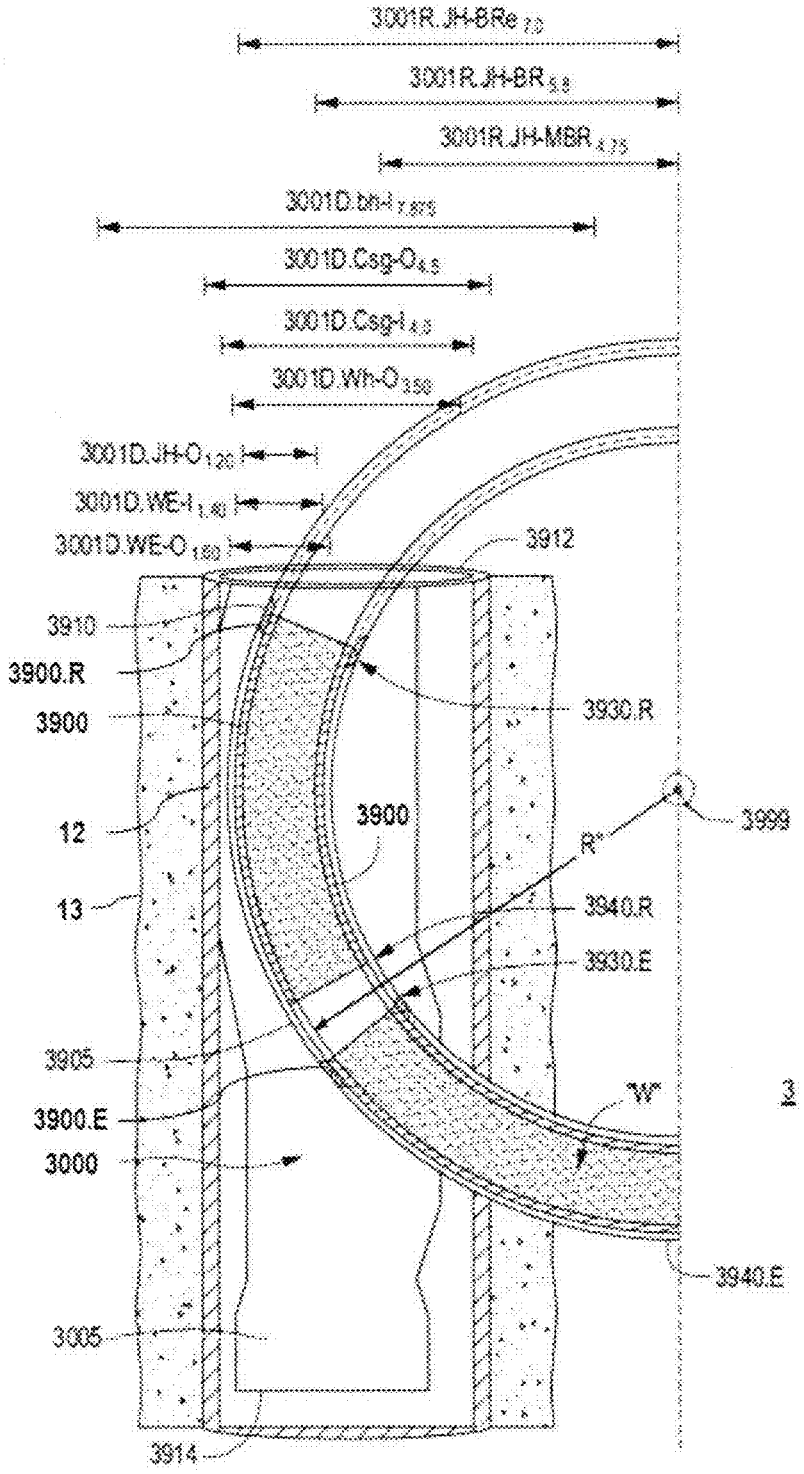

FIG. 3A provides a cross-sectional view of the same modified whipstock as depicted in FIG. 2B, with the exceptions: (1) that the cut-out section of the body is absent; and, (2) the sleeve has been included, shown in both its fully retracted and fully extended positions. Also shown is the Center Point for Bend Radius Measurements, from which the radius R" is measured.

Figure 3B:
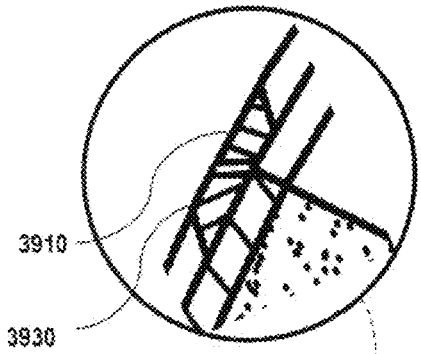
Figure 3B:
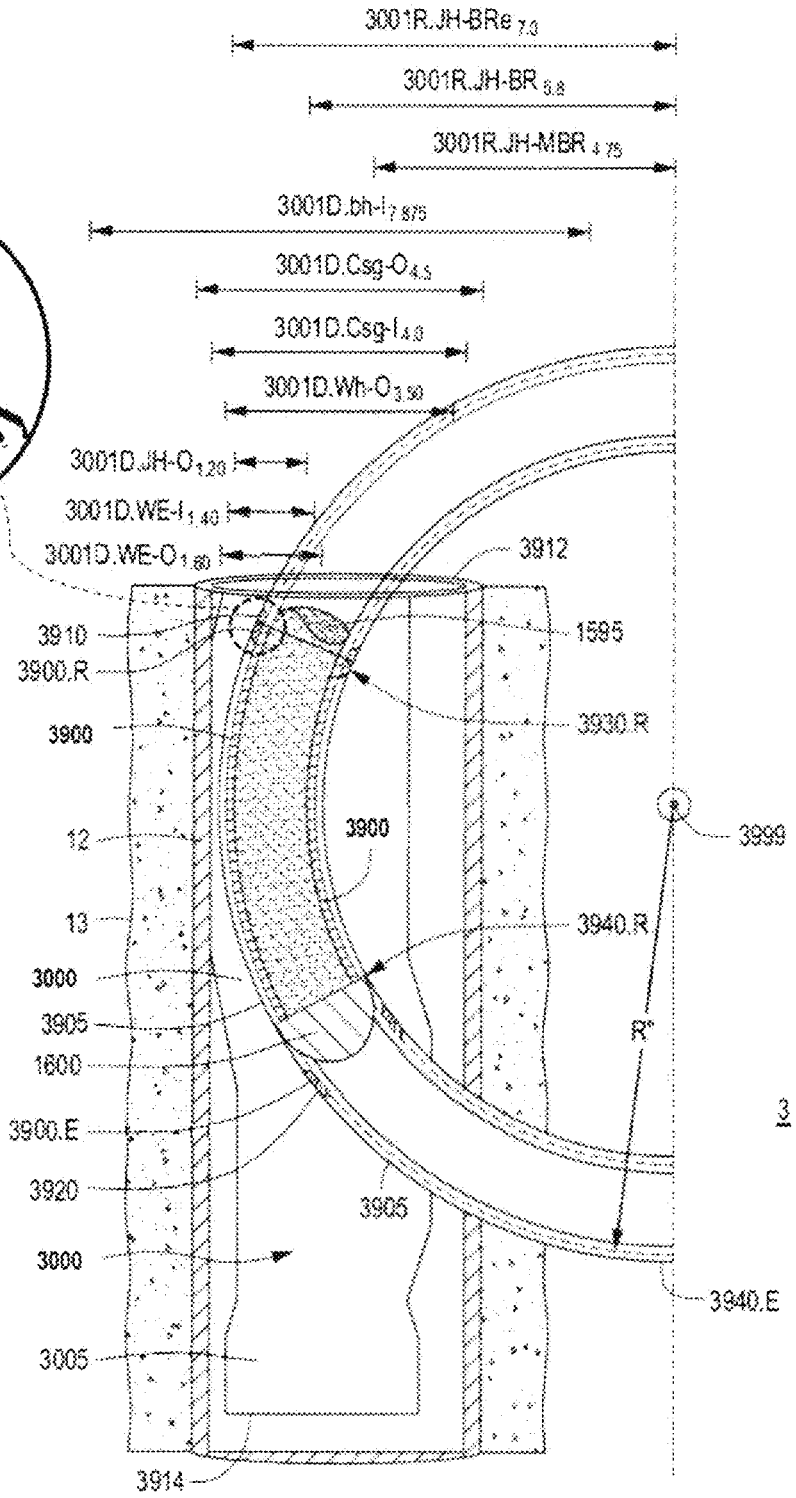

FIG. 3B provides a cross-sectional view of the extendible whipstock apparatus positioned in a horizontal position and is shown with the telescoping sleeve in the fully retracted (proximal) position. This occurs when the jetting assembly is retrieved back into the tool string.

Figure 3C:
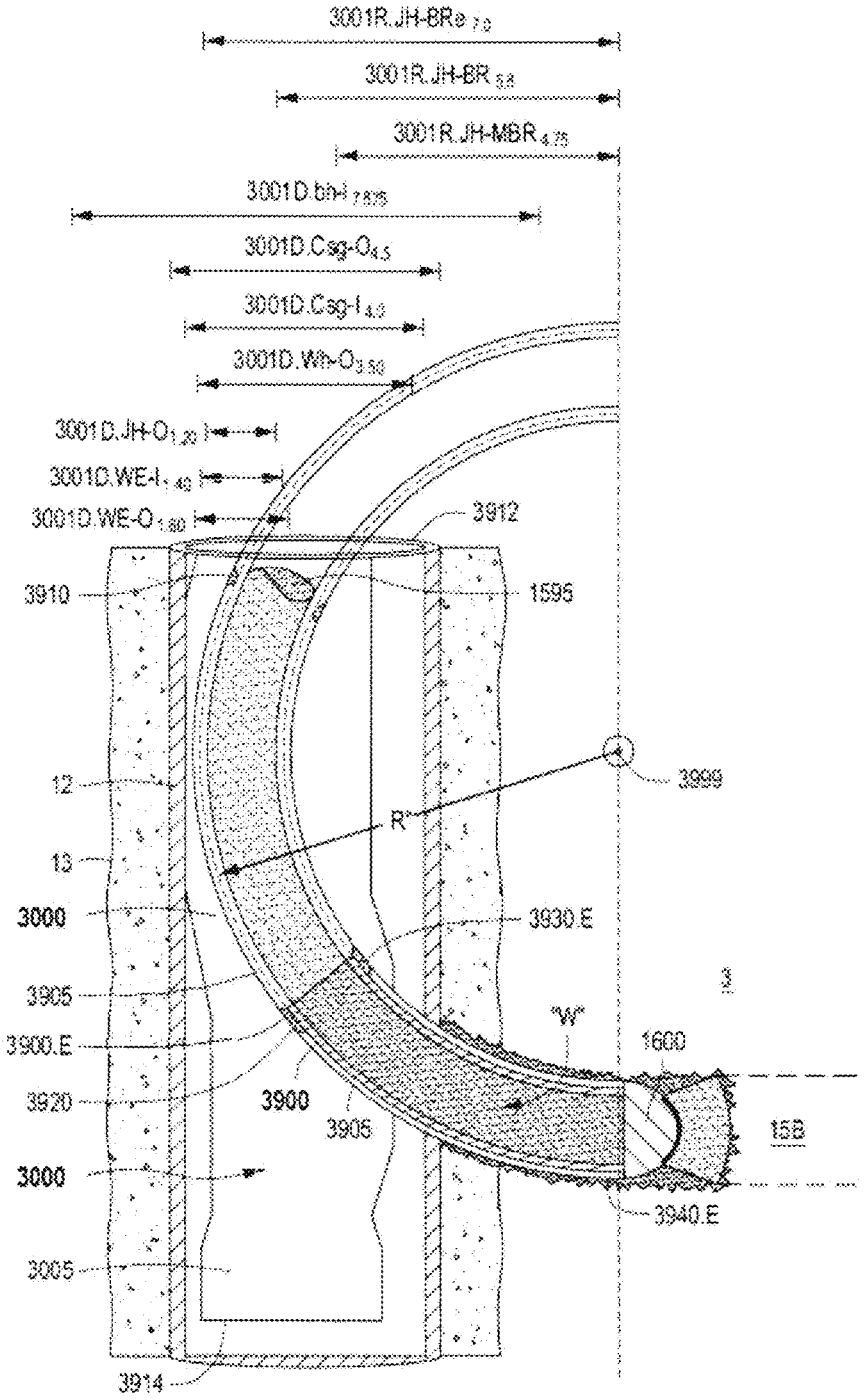

FIG. 3C is another cross-sectional view of extendible whipstock apparatus with the telescoping sleeve in its fully extended position. Here, as first the casing exit "W" was formed, followed by penetration through the cement sheath, then penetration into the pay zone 3, the distal edge of the sleeve has 'followed' the proximal edge of the jetting nozzle to the sleeve's fully extended position, where the sleeve's Upset Shoulder Stop is now contacting the whipstock's Lower Stop Ring.

Figure 3D:
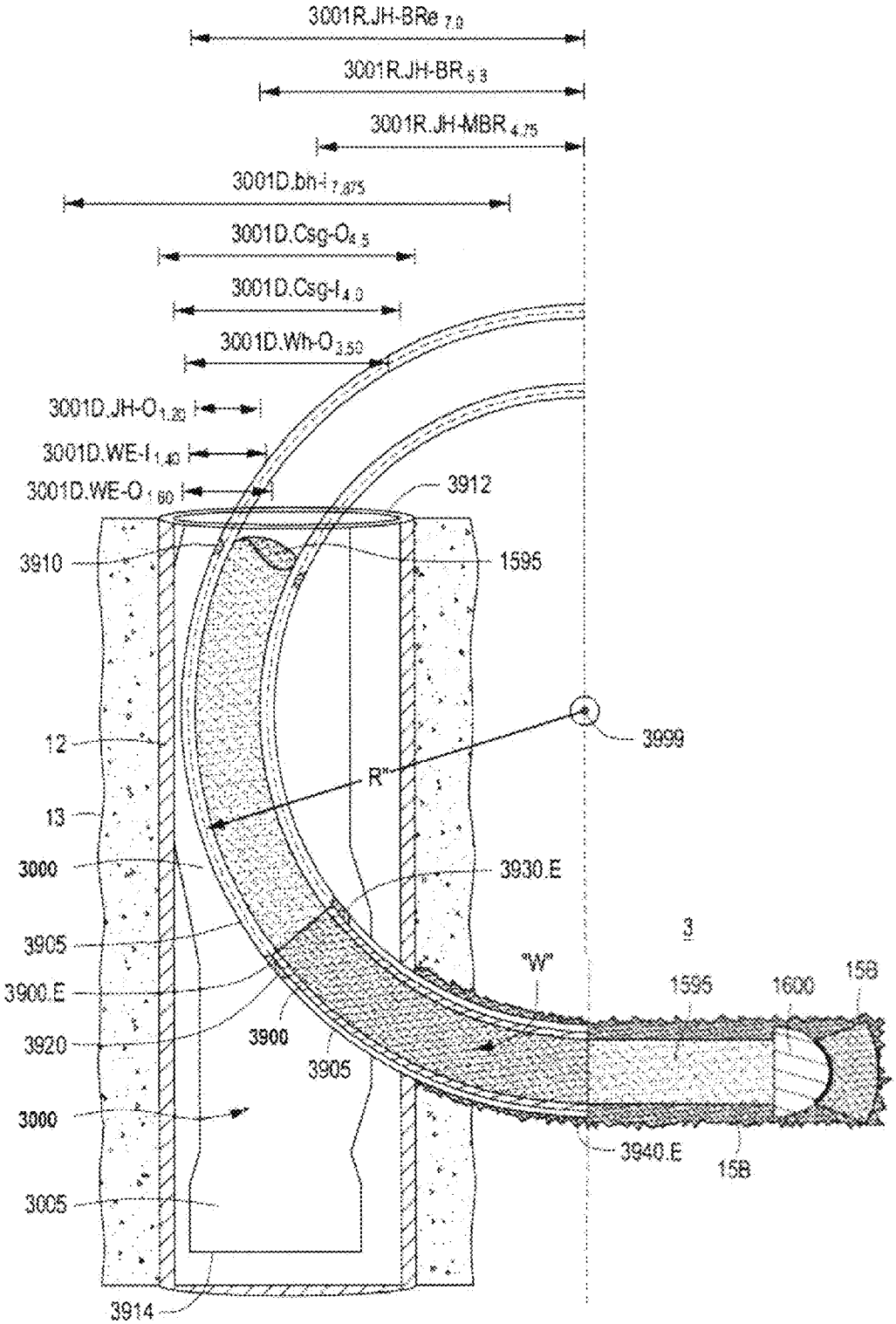

FIG. 3D is the same cross-sectional view as FIG. 3C, but with continued jetting of the UDP laterally away (approximately perpendicular to) the host wellbore. Obviously, with continued jetting the proximal edge of the jetting nozzle has long since pulled away from the distal edge of the sleeve.

Figure 3E:
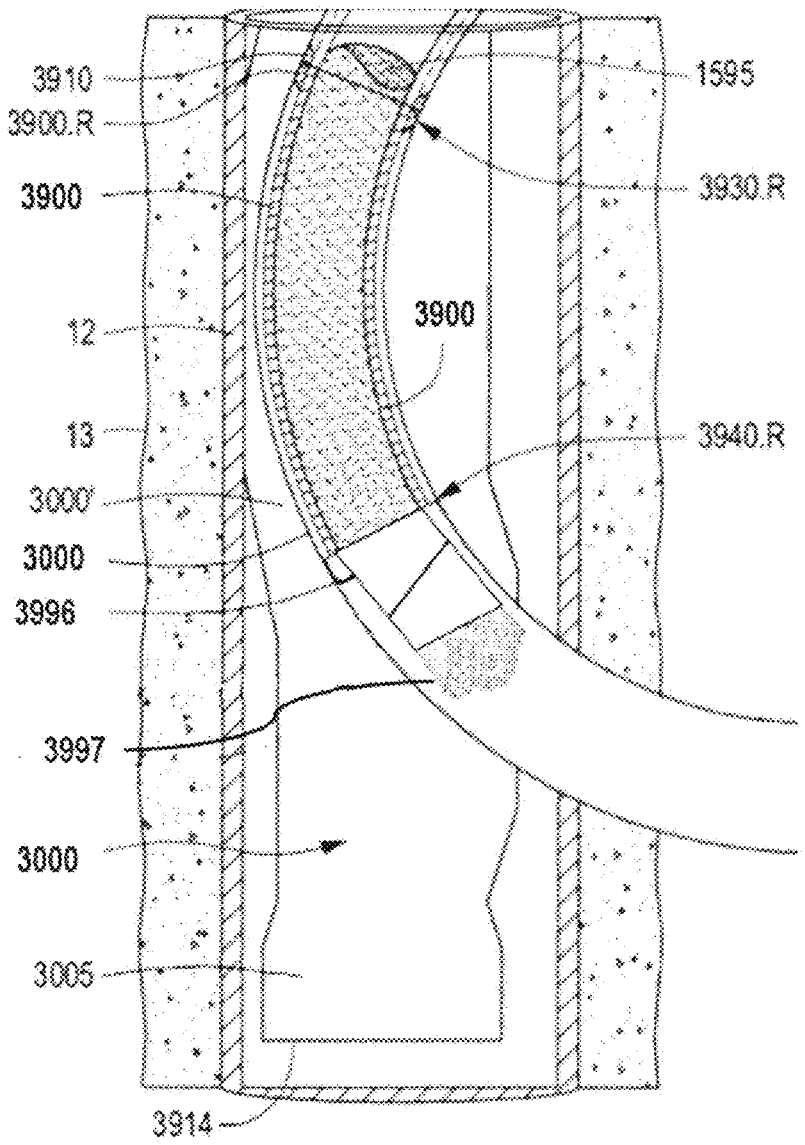

FIG. 3E is the same cross-sectional view as FIG. 3B, but depicts the option of using a motor and bit in lieu of a jet nozzle, presumably in applications in larger casing sizes that would enable the use of larger diameter tubulars or flexible conduits compatible with hydraulic motor and bit assemblies.

Figure 3F:
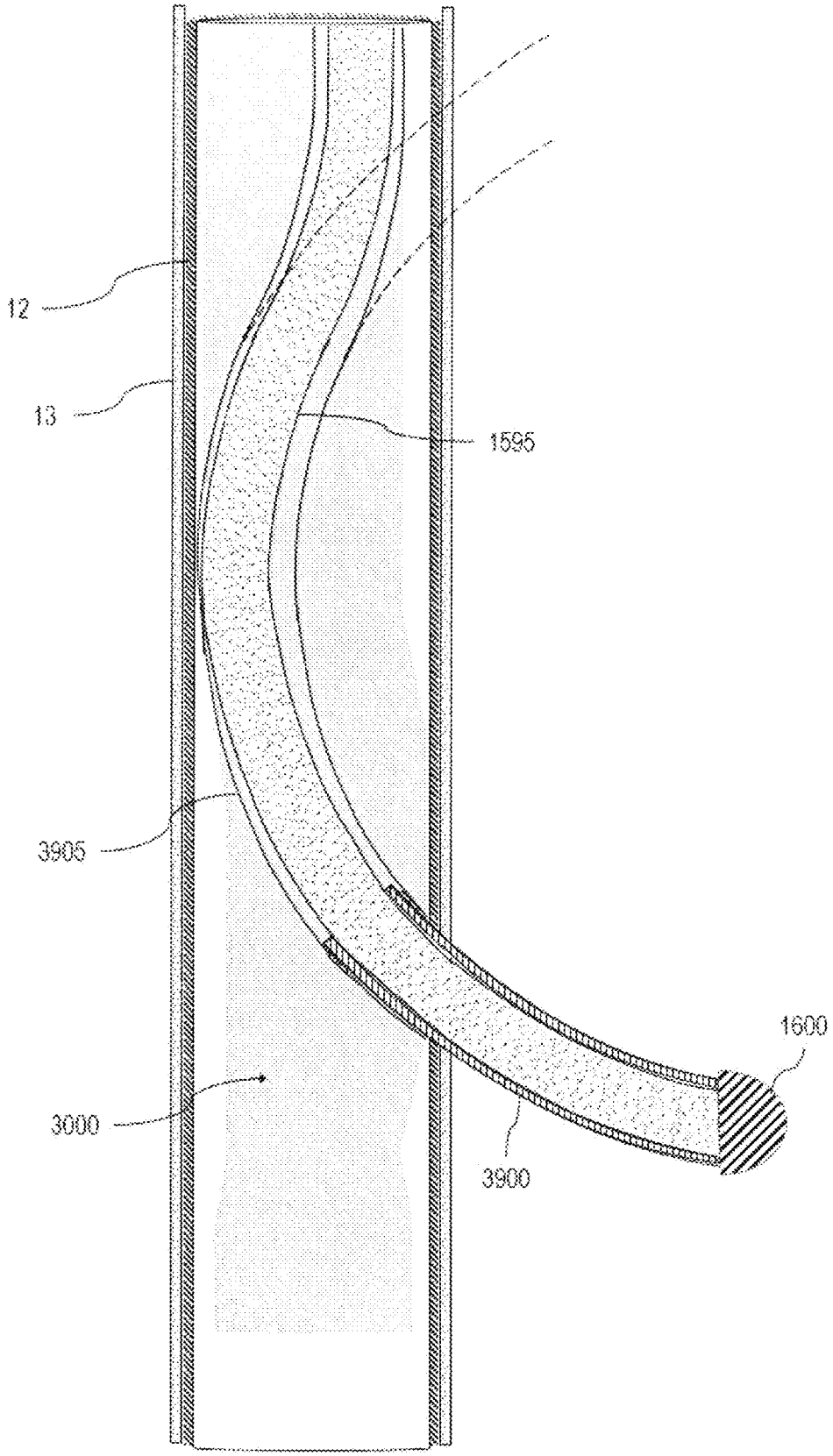

FIG. 3F depicts a typical jetting hose path as it enters the whipstock from the lower jetting assembly parallel to the tool string and wellbore. The jetting hose enters the top of the whipstock longitudinally and passes through the whipstock and the extension sleeve to ultimately exit the whipstock transversely to the wellbore.

Figure 4:
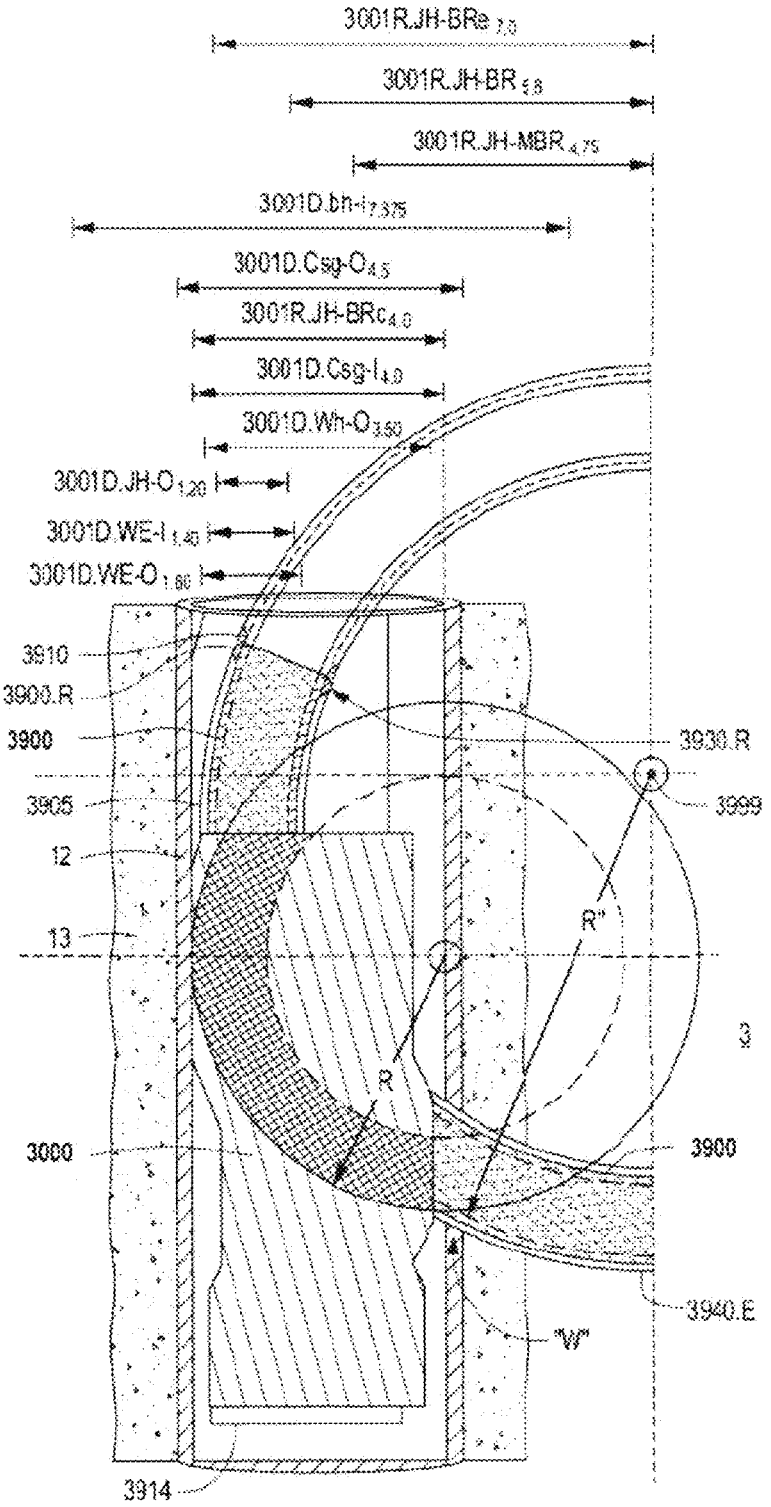

FIG. 4 is an overlay contrasting the bend radius magnitudes provided by: (1) a conventional whipstock such as in FIG. 2A or in FIG. 2B, where the whipstock provides an external bend radius R of 4.0 inches exactly equal to the casing I.D.; superimposed upon, (2) another whipstock, but one equipped with a telescoping sleeve.

Figure 5:
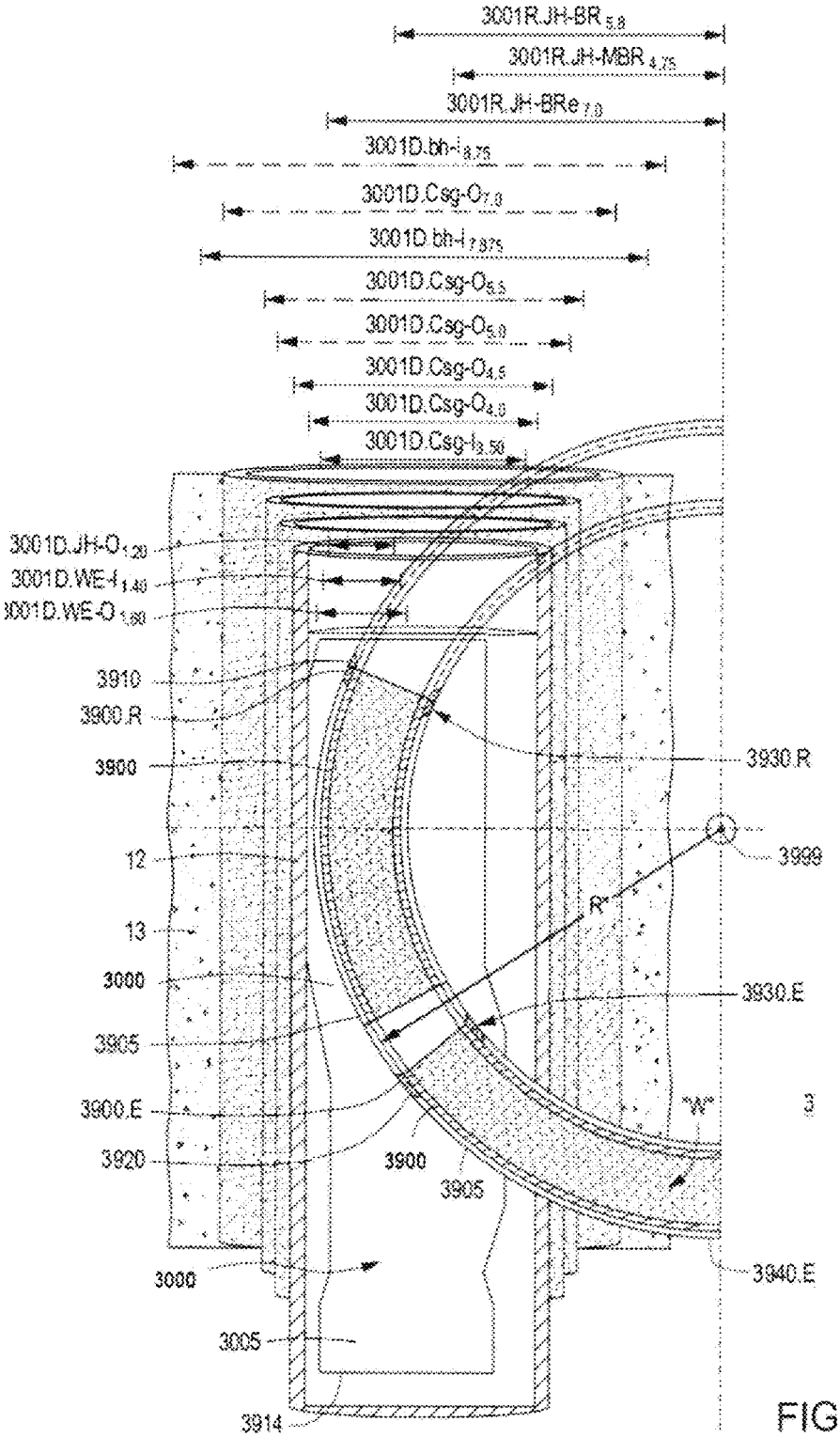

FIG. 5 is the same depiction as FIG. 3A, again to an approximate 2.5:1 scale, except with a background of to-scale depictions of the next three standard oilfield casing sizes; e.g., O.D.'s of 5.0, 5.5, and 7.0 inches.

Figure 5A:
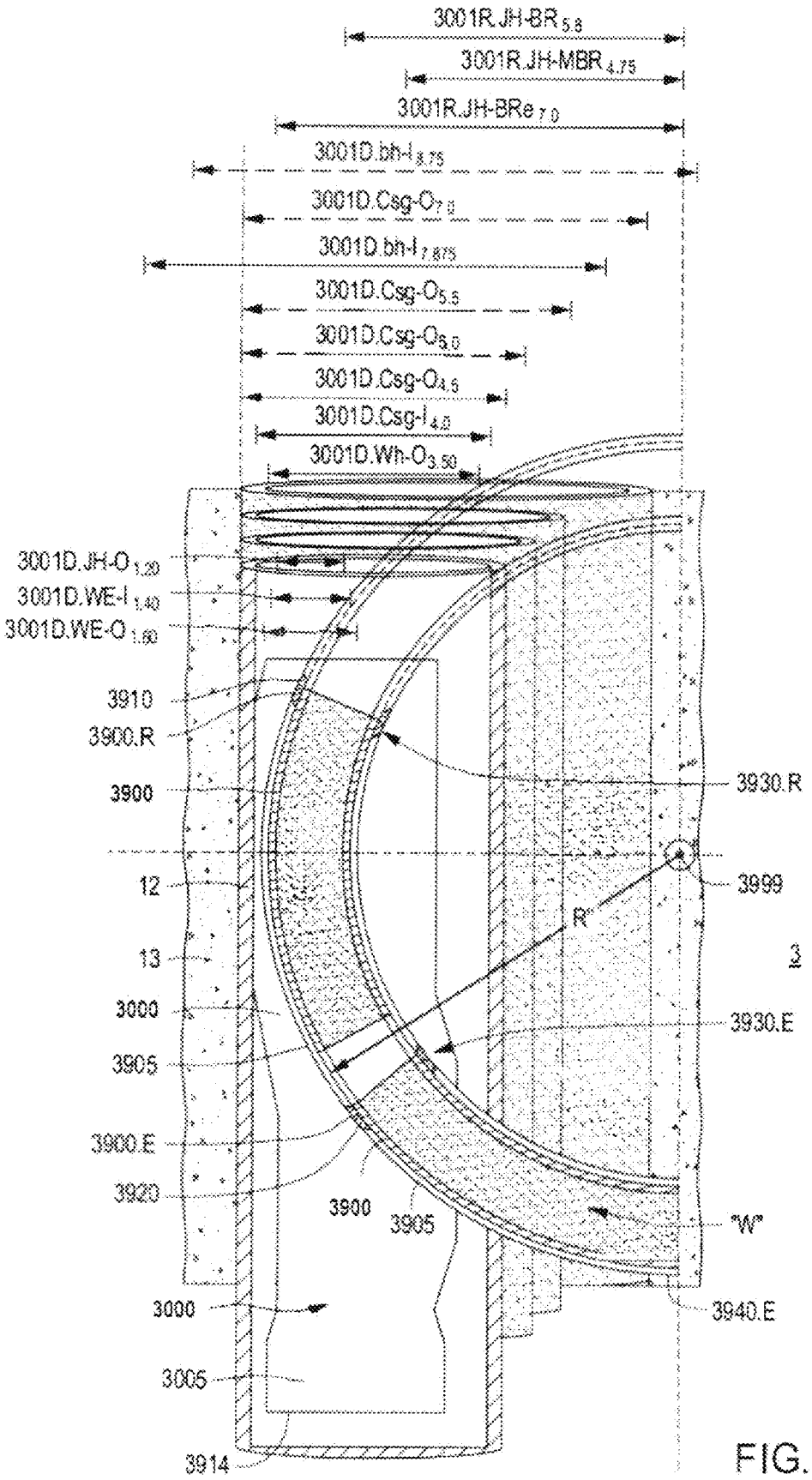

FIG. 5A is the same depiction as FIG. 5, again to an approximate 2.5:1 scale, with the same background of to-scale depictions of the next three standard oilfield casing sizes (O.D.'s of 5.0, 5.5, and 7.0 inches). However, instead of all casing and hole sizes being aligned on a common centerline, all of the casings have been aligned on a common (LHS) edge. The benefit of this depiction is that it illustrates the same extendible whipstock apparatus could be used for all four casing sizes.

Figure 5B:
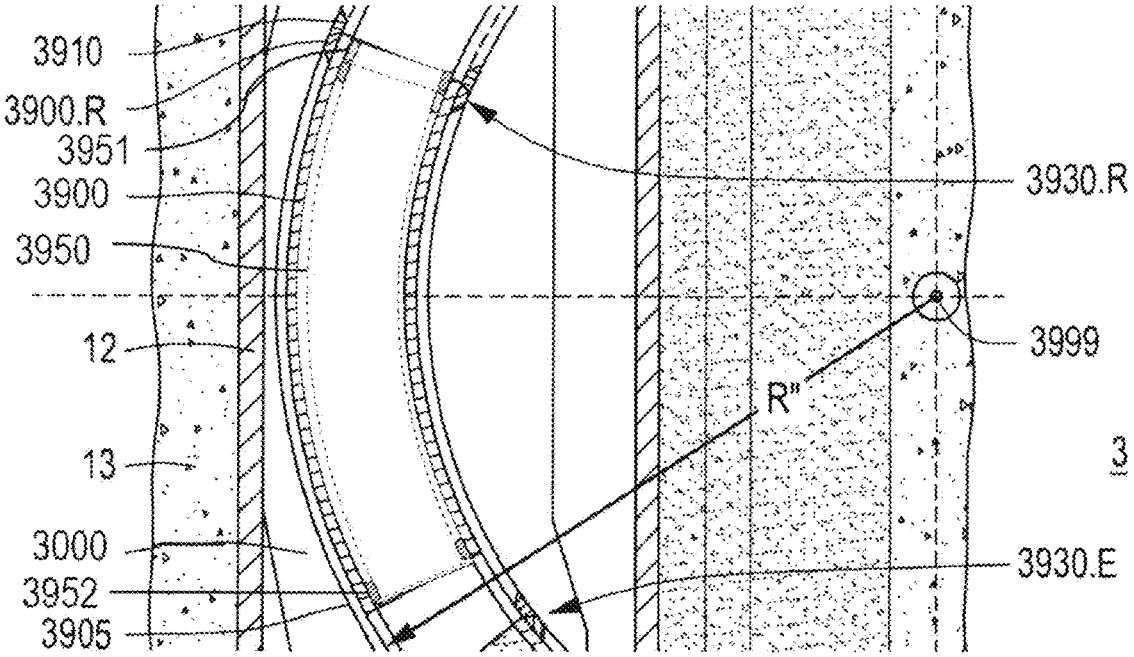

FIG. 5B is similar to FIG. 3A, but with the extension sleeve shown only in the retracted position. Also, FIG. 5B depicts not a single extension sleeve as in FIG. 3A, but rather multiple concentric, or "nested", telescoping extension sleeves that enable a larger minimum bend radius (MBR's) to be obtained versus the single-sleeve apparatus depicted in FIG. 3A.

Figure 5C:
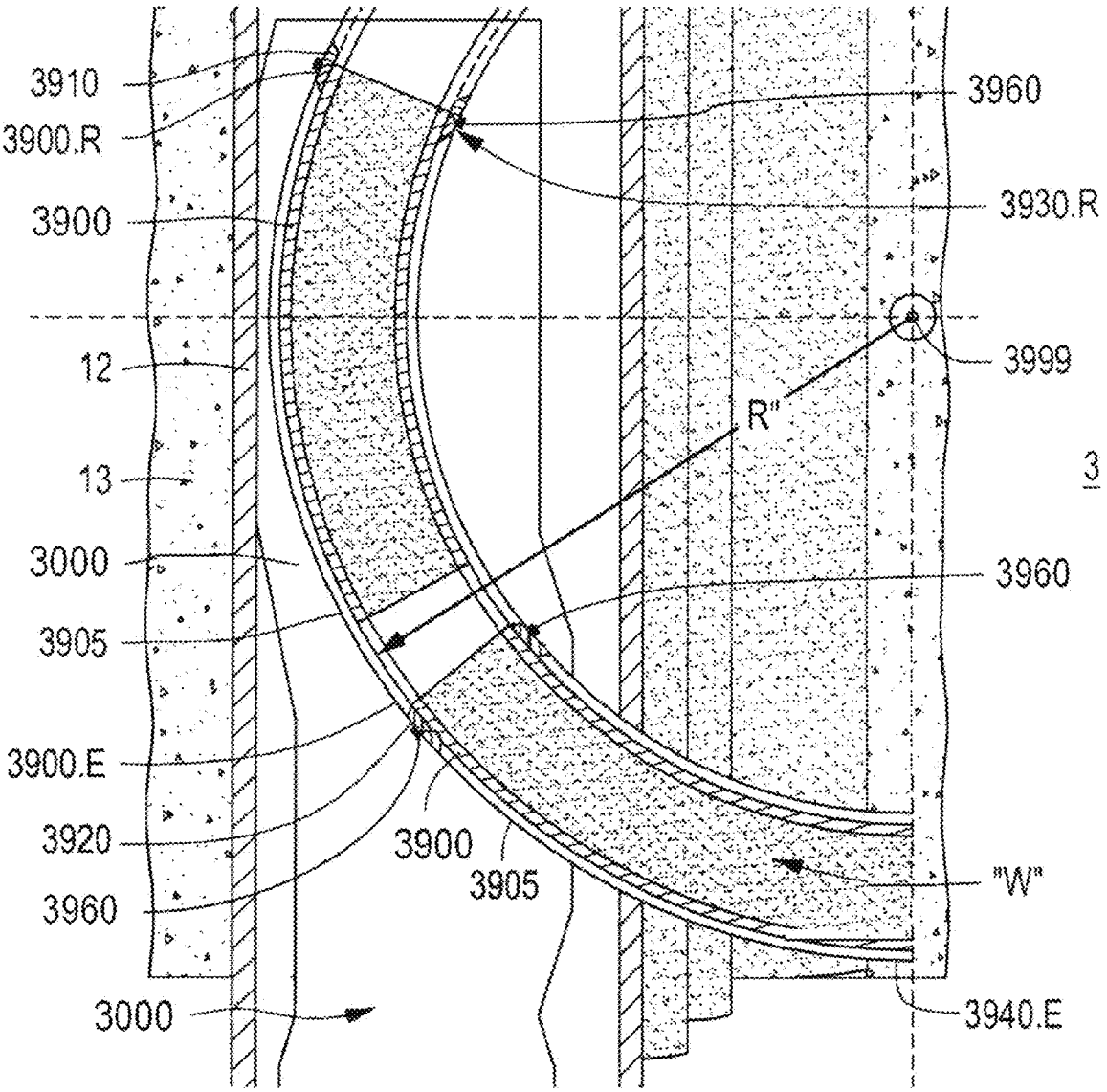

FIG. 5C is similar to FIG. 3A with the addition of position sensors that enable signals to be sent to the surface real-time as to when the sleeve is fully retracted, fully extended or at any position in between the sleeve's mechanical stop positions.

Figure 5D:
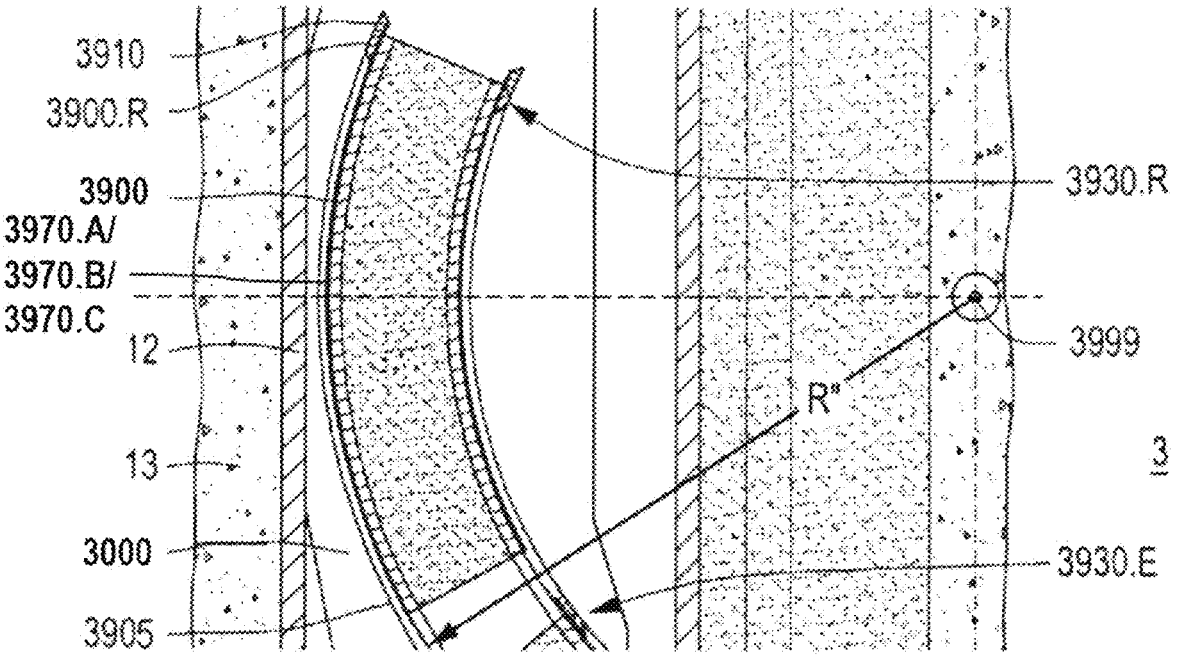

FIG. 5D is similar to FIG. 5B but with a single sleeve apparatus. The single-sleeve apparatus depicted in FIG. 5D, however, includes (a) an additional surface coating or treatment to reduce erosion and abrasion from the abrasive-laden slurry, (b) a friction-reducing coating and/or c) a lubricity-adding coating on the arcuate whipstock surface and/or the outer surface of the sleeve.

Figure 5E:
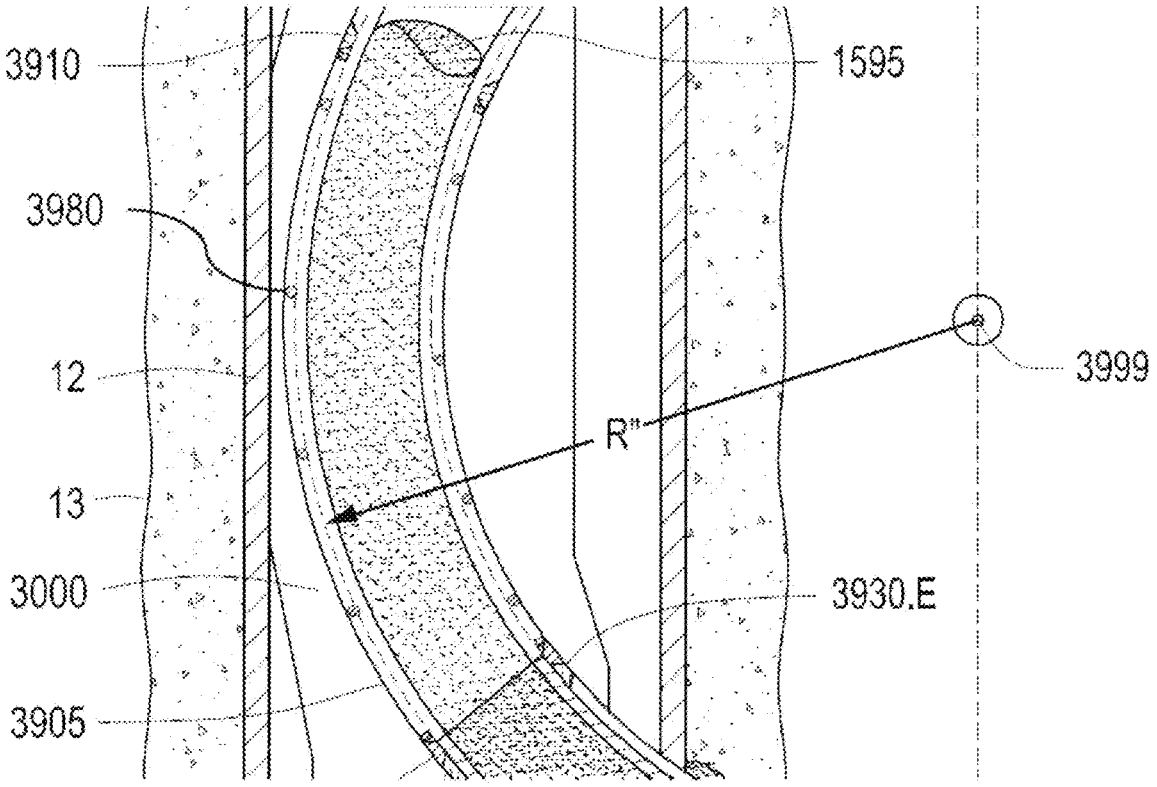

FIG. 5E is similar to FIG. 3C but with the addition of a biasing mechanism, e.g. a coil spring, to assist the sleeve in moving from the fully-retracted to the fully-extended position. Without the biasing mechanism, the friction between the hose O.D. and the I.D. of the sleeve and/or other means must be sufficient to move the sleeve from its retracted position.

Figure 5F:
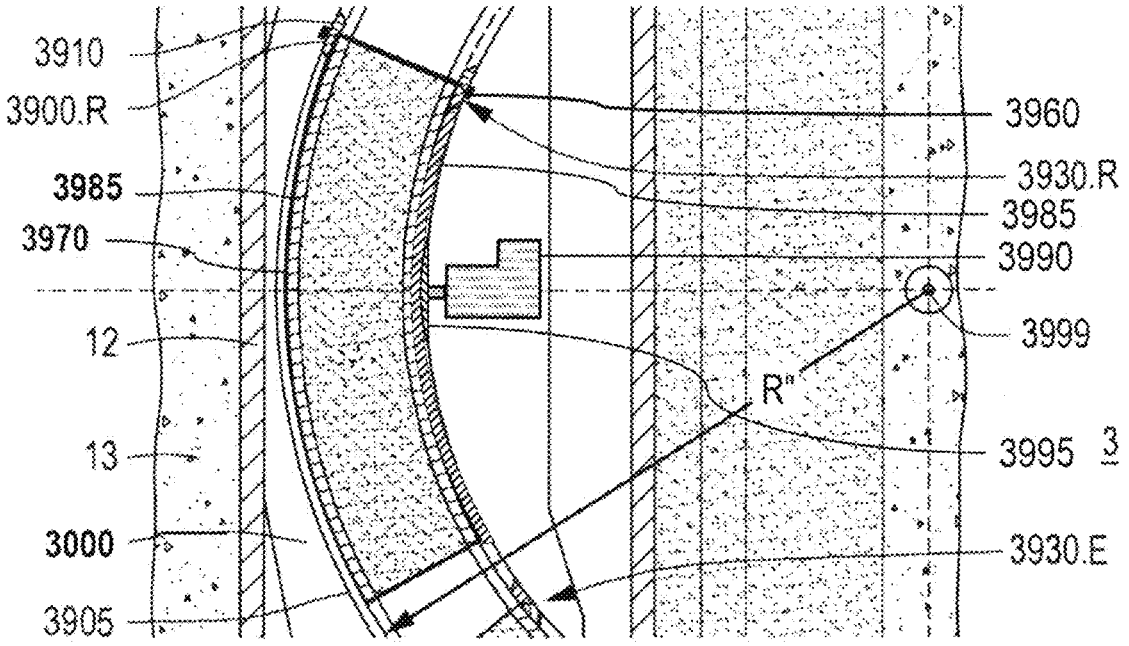

FIG. 5F is similar to FIG. 5D, but depicts the addition of a servo/electric motor, gear, gear-driven sleeve and position sensors. The servo-enabled apparatus permits the precision positioning of the sleeve's extension enabling the arc length and therefore the exit angle of the jetting assembly to be customized commensurate with the specific reservoir characteristics at each setting.

Figure 5G:
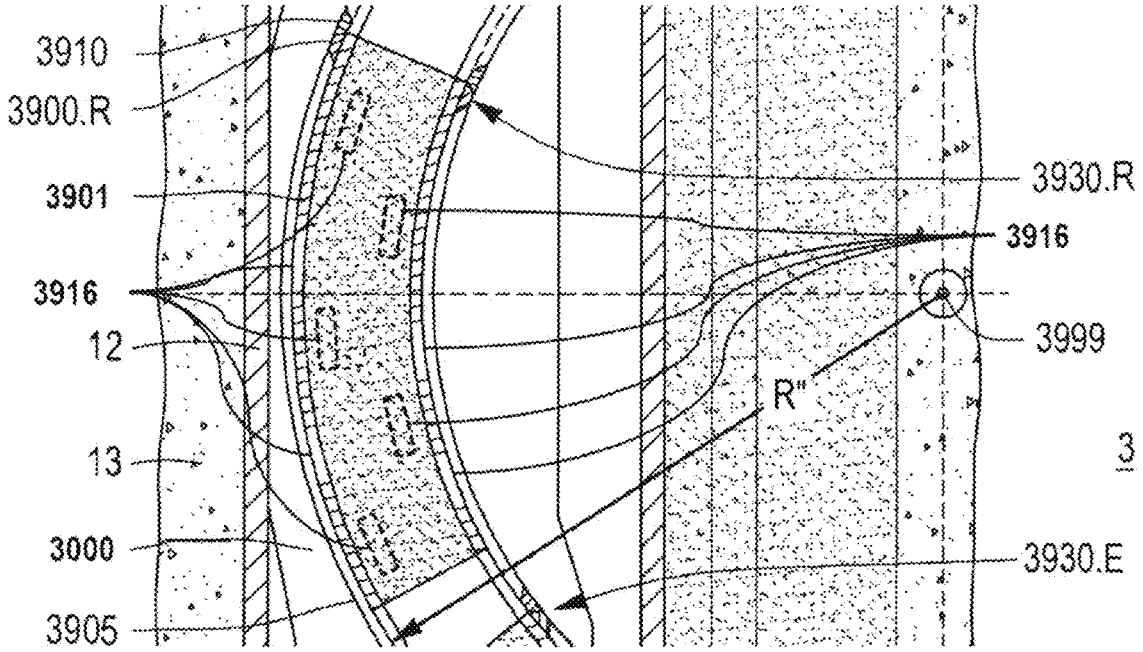

FIG. 5G depicts the telescoping sleeve apparatus with slots through the sleeve wall to help prevent any jetting slurry abrasive material, frac sand, formation tines or other debris from collecting and subsequently limiting or prohibiting the movement of the sleeve in the whipstock channel.

Figure 5H:
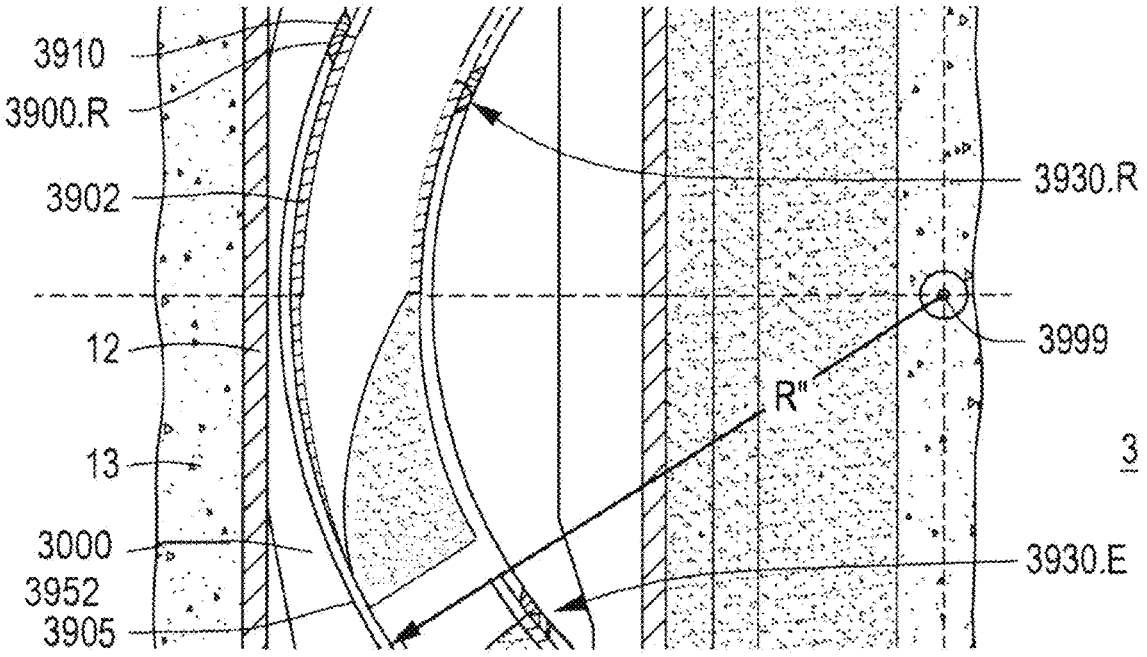

FIG. 5H depicts the telescoping sleeve apparatus with a scoop/tongue/shoehorn-shaped profile to facilitate the sleeve's entry into and movement through the jetted hole in the casing, cement and formation and/or the hole formed by the alignment of both the inner and outer sleeves of the custom ported casing collar depicted in FIG. 2B.

Figure 5J:
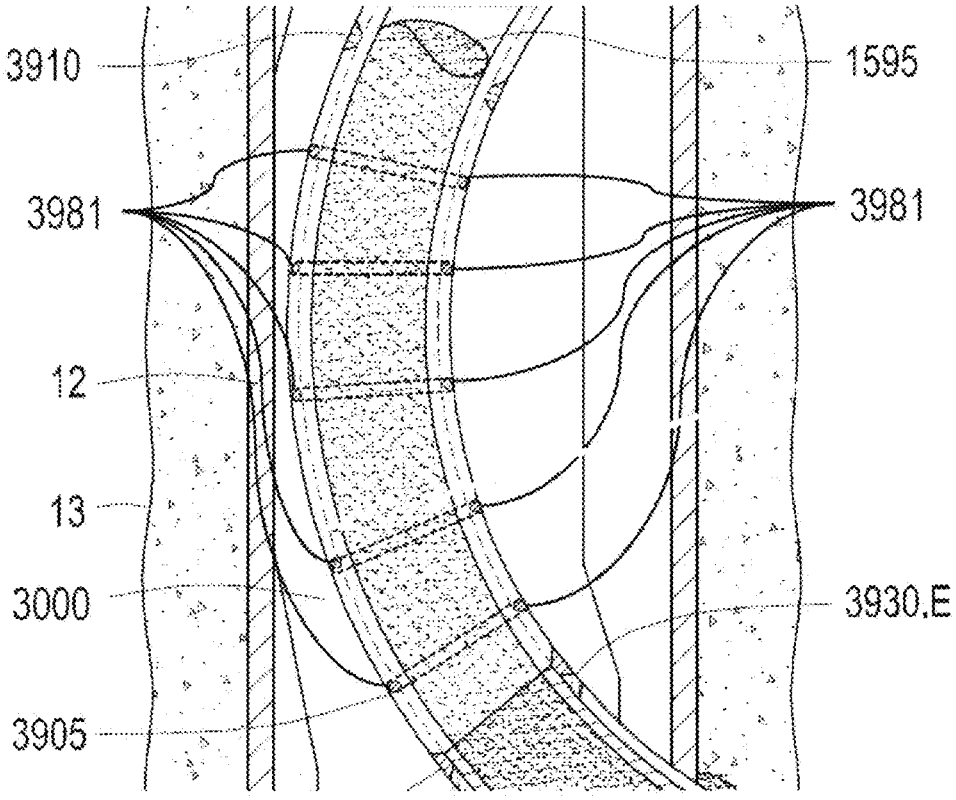

FIG. 5J depicts the telescoping sleeve apparatus with a series of bearings between the outer surface of the sleeve and the inner surface of the channel located in the whipstock body. The bearing facilitate both the extension and the retraction of the sleeve such that the frictional forces between the hose and the sleeve can more easily translate the sleeve positionally.

Figure 5K:
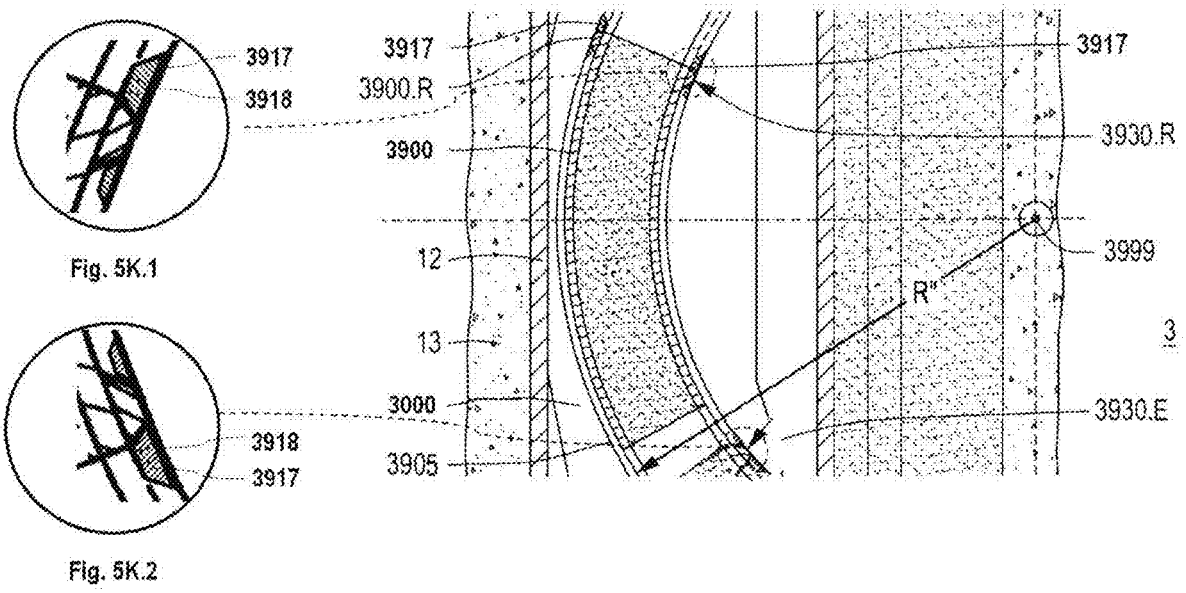

FIG. 5K depicts the telescoping sleeve apparatus with both proximal (FIG. 5K.1) and distal (FIG. 5K.2) latching mechanisms installed to prevent any premature movement of the sleeve prior to the sleeve's desired deployment and subsequent retraction with the jetting hose assembly.

Figure 6:
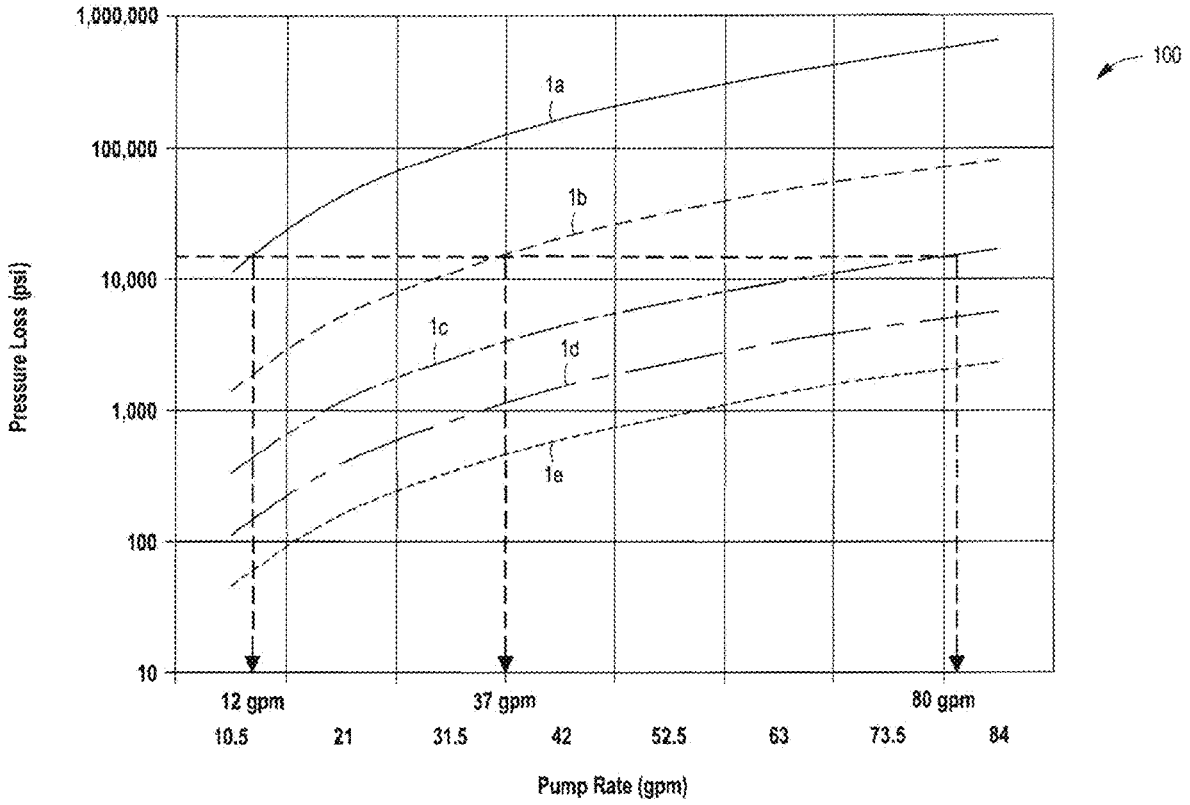

FIG. 6, described above, is a plot of Pressure Loss (psi, ordinate axis) versus Pump Rate (gpm, abscissa axis) at Pump Rates varying from zero to 2 barrels per minute. shown in increments of ¼ bpm through jetting hoses of I.D.'s ranging from ¼ inch through ¾ inches in ⅛-inch increments. Note Pressure Loss is plotted on a logarithmic scale.

Figure 7:
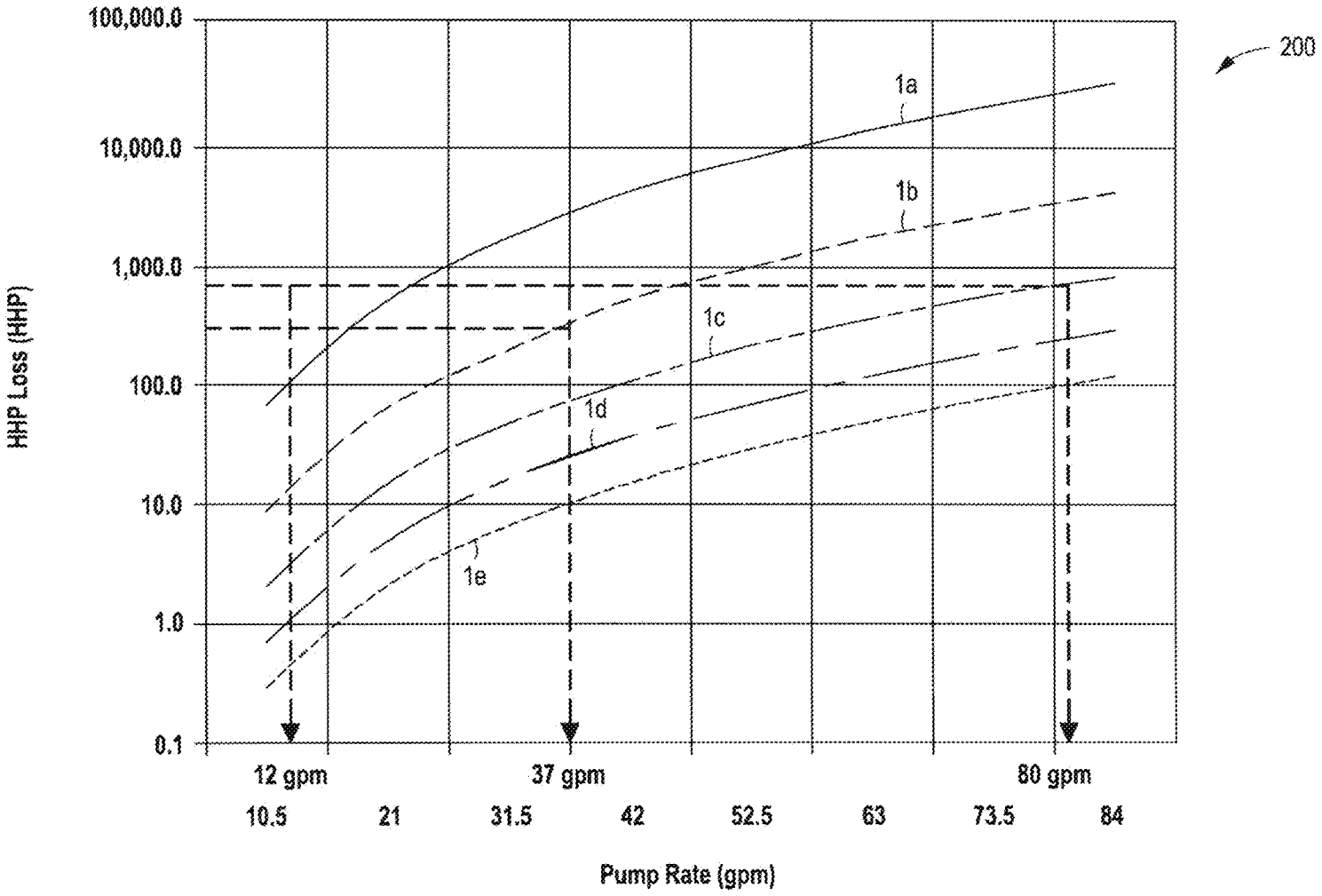

FIG. 7 is similar to FIG. 6, with the exception that, instead of Pressure Loss, it is Hydraulic Horsepower ("HHP") Loss, in horsepower, that is the logarithmic function plotted on the ordinate. The 12, 37, and 80 gpm cut-off rates correlative to the 15 k psi pressure limits of FIG. 6 are superimposed on FIG. 7, showing the HHP losses for the ¼, ⅜, and ½ inch I.D. hoses.

Figure 8:
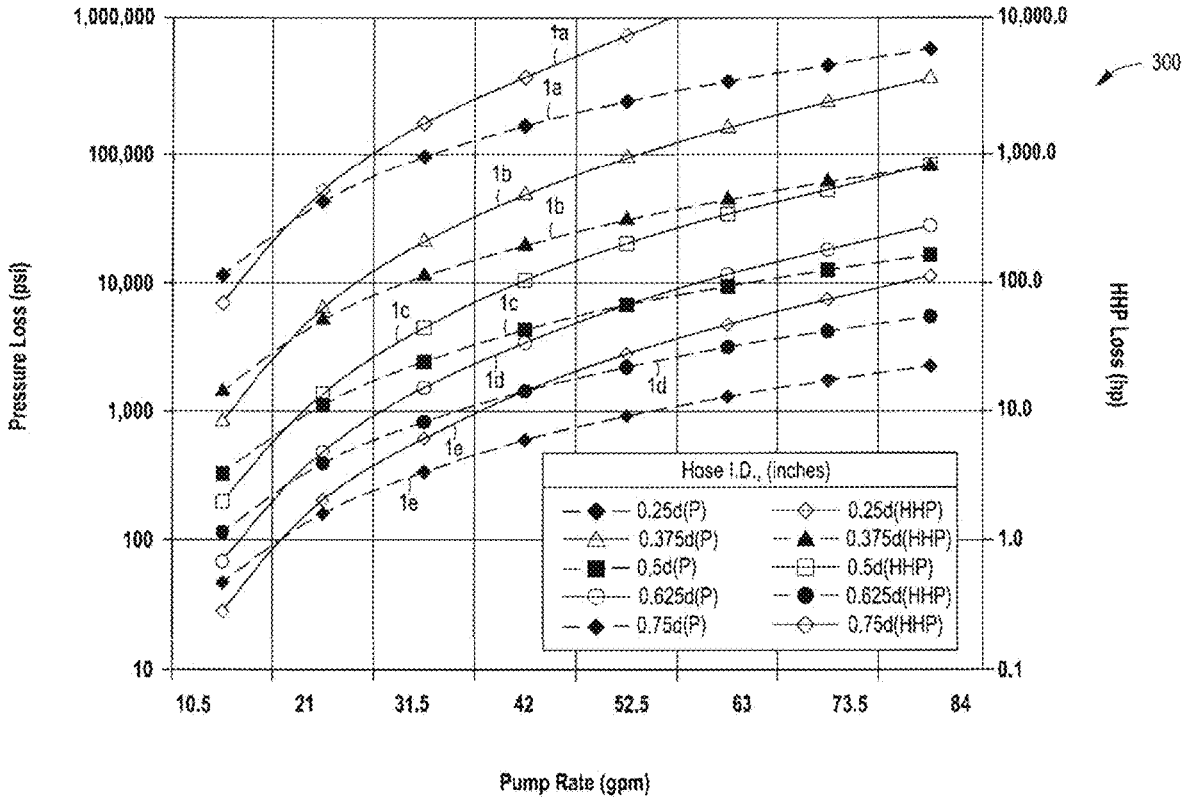

FIG. 8 depicts the same data as FIGS. 6 and 7, with Pressure Loss (psi) on the left hand ordinate axis, and HHP Loss on the right. Curve fits in the form of Equation 3, $Y=(\text{Coefficient})\cdot X^{(Exponent)}$, are shown to yield exceptionally good agreement for all ten data sets.

Figure 9:
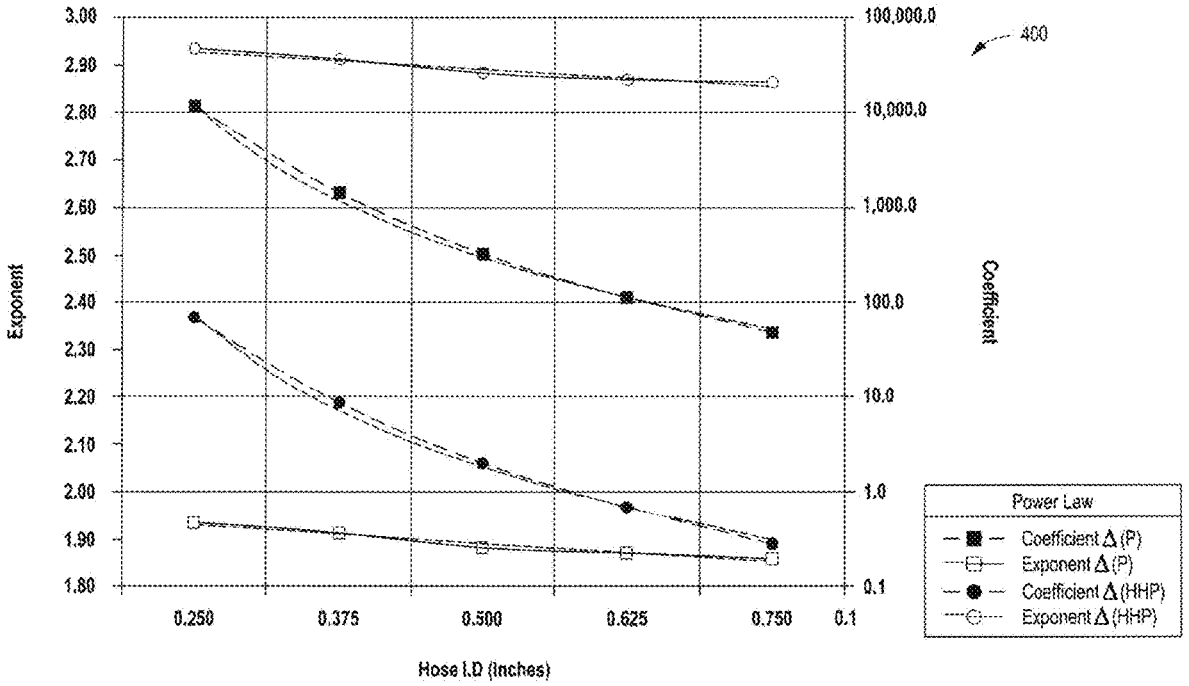

FIG. 9 depicts graphically the Exponents and Coefficients of Equation 3 for each of the subject hose I.D.'s, as determined from the curve fits performed for FIG. 8 are shown as plotted on the left hand and right hand ordinates (both logarithmic), respectively. Note the Exponents (LHS) are on a linear scale; the Coefficients (RHS) are on a logarithmic scale. The common (linear) abscissa axis is the Hose I.D., again in increments of $\frac{1}{8}^{th}$ inch.

Figure 10:
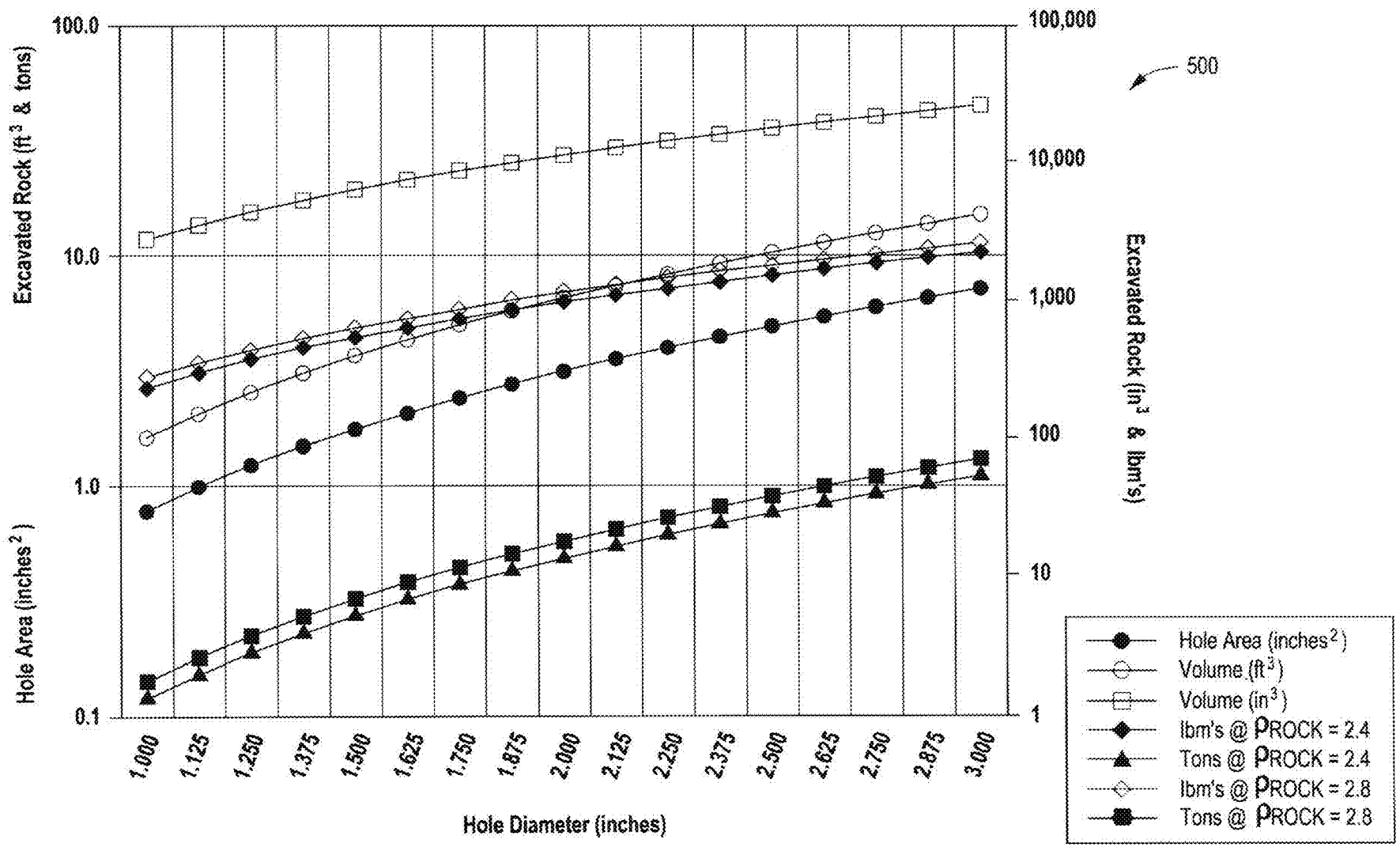

The last graph is FIG. 10, which depicts various logarithmic functions plotted on both left and right ordinate axis, with the common linear abscissa of UDP ("Hole") Diameter in inches. Depicted on the ordinate on the LHS are: Hole Area, in square inches; and, Excavated Rock Volume (cubic feet); and, Excavated Rock Mass (tons). Depicted on the ordinate on the RHS are Excavated Rock Volume (cubic inches); and, Excavated Rock Mass (pounds). The Rock Mass calculations, whether in pounds or tons, are conducted and plotted for two different values of Rock Density, $\rho_{ROCK}$, equals 2.4 or 2.8 grams/cc, thus providing boundary functions for relatively low and relatively high density pay zones. Also depicted are the polynomial curve fits of each function, each yielding a perfect "$R^2$" value of 1.0.

DEFINITIONS

As used herein, the term "extendible whipstock" refers to any device for increasing the bend radius of a flexible conduit deviating device, or "whipstock".

The term "whipstock" refers to any device for deviating the direction of a flexible conduit in a downhole setting within either a cased wellbore or an (uncased) open hole borehole, e.g., for a hydraulic/abrasive jetting application such that the flexible conduit (as a part of the jetting assembly) intersects the well casing, well cement (if present), and formation.

The term "formation" refers to a subsurface geological strata.

The term "pay zone" refers to a particular formation known to contain hydrocarbons in paying quantities for which a wellbore is inserted and completed. As used herein, part of that completion process involves hydraulically and/or abrasively jetting a mini-lateral borehole (or Ultra Deep Perforation, "UDP"), generally perpendicular to the longitudinal axis of the wellbore. Generally, and particularly in unconventional horizontal wells in a pre-hydraulic fracturing ("fracking") application, it is preferred that the longitudinal axis of the UDP's be generally parallel to the plane of maximum principle horizontal stress in the pay zone.

The term "ultra-deep perforation" ("UDP") refers to the resultant mini-lateral borehole produced by an RHJ operation in a subsurface formation, typically upon exiting a production casing and its surrounding cement sheath in a wellbore, with the borehole being formed in a pay zone. UDP's therefore preclude the need for conventional perforating. For the purposes herein, a UDP is formed as a result of abrasive and/or hydraulic jetting forces erosionally boring through the pay zone with a high pressure jetting fluid or slurry directed through a jetting hose and out a jetting nozzle affixed to the terminal end of the jetting hose. UDP's generally have relatively small diameters, typically 2 inches or less.

As used herein, the term "subsurface" refers to geologic strata occurring below the earth's surface.

The term "borehole" as used herein refers to the excavated void space in the subsurface, typically of circular cross-section and generated by excavation mechanisms; generally by either drilling or jetting. A borehole may have almost any longitudinal azimuth or orientation, and may be up to hundreds (jetting) or more typically thousands or tens of thousands of feet in length (drilling).

As used herein, the term "wellbore" refers to a borehole excavated by drilling and subsequently cased (typically with steel casing) along much if not its entire length. Usually at least 3 or more concentric strings of casing are required to form a wellbore for the production of hydrocarbons. Each casing is typically cemented within the borehole along a significant portion(s) of its length, with the cementing of the larger diameter, shallower strings requiring circulation to surface. As used herein, the term "well" may be used interchangeably with the term "wellbore." Wellbores are typically classified by the general orientation of the longitudinal axis of the borehole as it penetrates the pay zone: either vertical, horizontal, or directional.

As used herein, a "horizontal wellbore", or "horizontal well" is a well that has typically drilled vertically to a planned "kick-off" point, at which the trajectory starts to "build angle", turning the trajectory of the well from a generally vertical to a generally horizontal orientation. From the terminus of the well's vertical section to the beginning of its horizontal section thus forms the "heel" section of the well. A generally horizontal orientation is continued through the horizontal lateral section of the well for many thousands of feet . . . perhaps for a distance approaching almost 4 miles. The terminal portion of the horizontal lateral is referred to as the "toe" section.

The term "jetting fluid" refers to any fluid pumped through a jetting hose and nozzle assembly for the purpose of erosionally boring a lateral borehole from an existing (cased) wellbore or (openhole) borehole. The jetting fluid may or may not be in liquid form. The jetting fluid may or may not contain an abrasive material.

The term "abrasive material" or "abrasives" refers to small, solid particles mixed with or suspended in the jetting fluid to enhance the erosional degradation of the target by the (jetting) fluid (or "slurry") by adding to it destruction of the target face via the solid impact forces of the abrasive. Targets typically referenced herein are: (1) the pay zone; and/or (2) the cement sheath between the production casing and pay zone; and/or (3) the wall of the production casing at the point of desired casing exit.

The term "jetting slurry" is a jetting fluid that always contains an abrasive material.

The term "jetting hose" refers to a flexible fluid conduit, typically containing multiple reinforcement layers such as spiral or braided wire or braided Kevlar reinforcing a fluid conducting core such as PTFE, and is thus capable of conducting relatively small volumes of fluids at very high or even ultra-high pressures, typically up to thousands or tens of thousands of psi.

As used herein, the "minimum bend radius" ("MBR") of a jetting hose will be defined as: " . . . the smallest diameter that a looped hose can achieve without damage and is measured as the distance to the inside edge of the hose (not the center line) when making a 90-degree bend." [https://www.crossco.com/resources/technical-bulletins-guides/bend-radius-in-hydraulic-hose/] Note this definition presumes the 90-degree bend is occurring in a single plane. As used herein, the term "external bend radius" of a jetting hose will be defined as the distance from the pivot or center point established when a jetting hose follows an arcuate path while making a 90°-turn in a common plane, such that continuation of that same arc beyond 90° would eventually form a perfect circle. The external bend radius is simply the radius measured from the center point to that hypothetically perfect circle formed along the outside edge of the fully looped jetting hose. From that same center point, it is also the distance to the whipstock device's arcuate surface or ramp where the surface of the jetting hose actually contacts the device.

As used herein, the term "bend radius" or "actual bend radius" is simply the difference between the external bend radius and the outer diameter of the jetting hose. It is presumed to always be greater than or equal to the minimum bend radius.

DETAILED DESCRIPTION OF THE PREFERRED EMBODIMENTS

A downhole apparatus and method of enhancing the range of a whipstock in constructing a mini-lateral borehole (or Ultra Deep Perforation, "UDP") off of a host wellbore (or borehole) by: (1) dynamically locating the trajectory of a high pressure jetting fluid along a predetermined arcuate path; while, (2) concurrently establishing in situ a temporary, rigid, and enlarged bend radius for the flexible jetting fluid conduit. The curved, rigid, and telescopic aspects of the apparatus both support and guide the distal end of the jetting assembly as it erosionally excavates the arcuate path, first through the well casing (or ported casing collar), then through the well's cement sheath, and finally on out into the subsurface formation (typically, the pay zone).

The apparatus then serves to encase the initial, curvilinear portion of the UDP, while establishing the final, linear trajectory for the jetting nozzle as the nozzle disengages from the apparatus and advances on out into the pay zone to construct the remainder of the UDP. At this point of nozzle disengagement, the apparatus is at its final (and typically, fully) extended position, at which it remains while acting as a rigid sleeve serving to establish and maintain the new, expanded bend radius for the remainder of the jetting hose to be fed through it. Upon completing the UDP and retrieving the jetting hose, the proximal end of the jetting nozzle once again abuts to the distal end of the apparatus, pulling it back into the body of the whipstock to its initial, fully retracted position. While retracted, the apparatus on longer protrudes beyond the dimensions of the whipstock's body, and is therefore in a safe running position for the whipstock to be reoriented and/or relocated within the host wellbore, where the jetting of another UDP at the new whipstock location can be initiated.

Ultimately, this apparatus and method for providing an enlarged bend radius available to the flexible conduit (jetting hose) may be the critical determinant of whether erosional excavation of UDP's in a given pay zone is economically successful, or even whether it is even physically possible at all. This is particularly the case with the "tighter", higher compressive strength unconventional pay zones (including shales) pursued via horizontal drilling in approximately 85% of wells drilled on U.S. land today. As depicted by Graphs 1 and 2, losses of both jetting pressure and hydraulic horsepower are exponentially higher with diminishing jetting hose diameters. These sacrificed quantities of pressure and HHP, otherwise deliverable to the nozzle, may be the difference in erosionally excavating UDP's economically (i.e., with a satisfactory penetration rate) . . . or, if the hose loss reduces the jetting pressure exiting the nozzle to below the critical value of the pay zone's Threshold Pressure, $P_{Th}$, then no erosional boring can occur at all. (Reference Equation 4.) It is no wonder, then, that in a typical radial hydraulic system ("RHJ") deployed on coiled tubing, over 90% of the system's pressure and HHP losses occur in the jetting hose.

The critical driver that typically forces operators into smaller I.D. hose selections, thereby imposing these unwanted magnitudes of pressure and HHP losses, is the minimum bend radius ("MBR") rating of the jetting hose. For applications of jetting hoses at downhole conditions, the MBR is just as critical as the pressure and temperature ratings of the hose. By definition, bending a jetting hose to a radius less than that of its MBR will cause a perturbation to the physical structure the hose itself . . . that is, it will irreversibly damage it, even after re-straightening . . . thus reducing the pressure integrity of the hose. Unfortunately, increasing the jetting hose I.D. to a magnitude that overcomes the otherwise debilitating losses of pressure and HHP almost always brings with it a commensurate upsizing of the MBR requirement as well. And recall, given most RHJ applications call for a jetting path essentially perpendicular to the wellbore, this 90° turn of the jetting hose must be accomplished entirely within the confines of the wellbore's production casing (or, if open hole, borehole). That is, if one relies on existing downhole hose bending technologies, such as a "diverter shoe" or a whipstock. These existing technologies are all identical in one very important aspect. whether they are multi-trip systems run on tubing (diverter shoes), wireline, or even single-trip systems run on coiled tubing or e-coil (whipstocks, such as the precedent work's U.S. Pat. No. 9,976,351 entitled "Downhole Hydraulic Jetting Assembly"). That is, the geometry and configuration of the device applying the bending moment (i.e., as the hose is forced into it, thus shaping its arcuate path) is entirely static. Even though the curvature of the bend may be formed from multiple and/or actuatable components, when once formed it does not change throughout the whole UDP-generating operation. Even the precedent work's mateable whipstock and Custom Ported Casing Collar ("CPCC"; reference U.S. Patent Application No. 2019-16/246,005, "Ported Casing Collar For Downhole Operations, And Method For Accessing A Formation", filed Jan. 11, 2019), which utilizes curved ports in the inner and outer sleeves of the CPCC to align with the whipstock, thus completing and extending the bend arc for the hose, is static throughout the UDP jetting process.

Quite simply, then, for operators to escape the pressure and HHP restrictions of smaller diameter hoses, what is needed is an apparatus that can provide for an arcuate bending path that is greater than the I.D. of the casing, or in the case of CPCC's, greater than the O.D. of the casing collar. Such a path would need to be formed insitu and dynamically. Specifically, the hose bending path would need to be established immediately behind the jetting nozzle as the borehole is excavated, but ahead of, or at least contemporaneously with the advancement of the very distal end of the jetting hose itself. The established bending path needs to not only extend, but remain established to accommodate the feed of the entire length of jetting hose desired for formation of the UDP. Upon retrieval of the jetting hose and nozzle, the hose bending apparatus must be able to resect back into the whipstock body, as not to impede the whipstock's reorientation and/or depth relocation for jetting of the next UDP. These are the basic design objectives for a dynamic, insitu, and repeatably extending/retracting hose bending device, referenced herein as an "Extendible Whipstock".

Figure 1A:
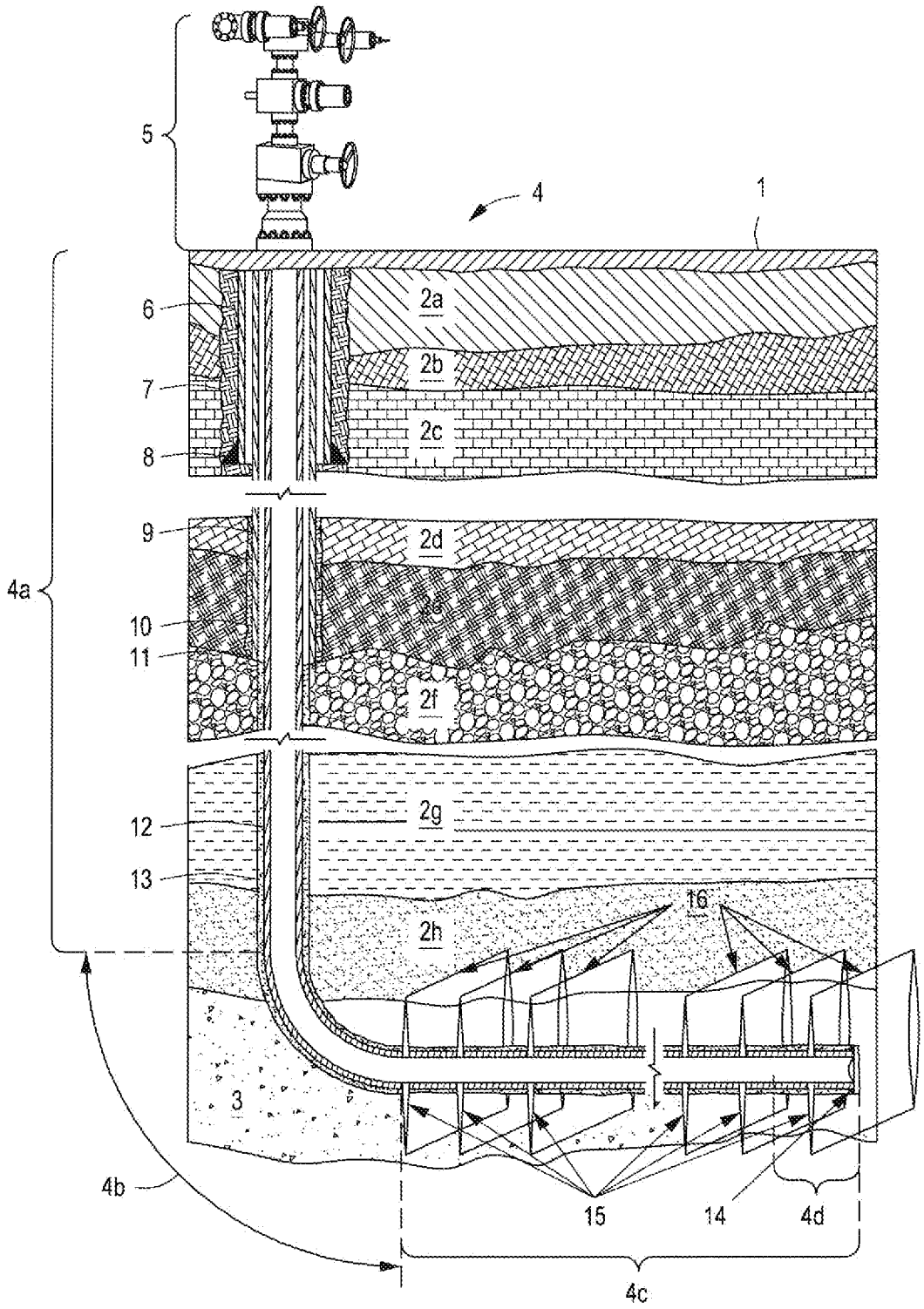
FIG. 1A provides a cross-sectional view of a typical horizontal wellbore that has been cased and cemented, then completed with conventional perforation clusters that have subsequently received multiple hydraulic fracturing stages. Fracture "half-wings" are shown emanating from perforations.

An examination of FIG. 1A underscores the importance of the above-defined extendible whipstock design criteria. Depicted therein is a half-section view of a typical horizontal wellbore, of the type comprising approximately 85% of all wells being drilled and completed on U.S. land at the time of this writing. Herein we see where, at the top of the "heel" section 4*b*, the drilling trajectory for the wellbore 4 was "kicked off", such that it could "build angle" from an essentially vertical to an essentially horizontal trajectory. This horizontal trajectory is held from the deepest elevation of the heel 4*b* throughout the horizontal lateral section 4*c* and through the "toe" section 4*d*. (In practice, the actual toe elevation may be in a "toe up" or "toe down" configuration, depending on the well plan.) As drilling and completion technologies have advanced, lateral sections 4*c* have increased greatly in length, nowadays up to several miles. The next effect has been, especially for coiled tubing ("CT", or electric line equipped CT, "e-coil") conveyed completion systems, such as the novel downhole hydraulic jetting assembly disclosed in co-owned U.S. Pat. No. 9,976,351 (entitled "Downhole Hydraulic Jetting Assembly", herein incorporated by reference in its entirety), that the time to trip in and out of the wellbore 4 has become increasingly significant . . . and expensive. Note in FIG. 1A the couplets of perforations 15 penetrating production casing 12 and cement sheath 13, and the fracture half-wings 16 extending into pay zone 3 (and, unwantedly, into the overlaying subsurface section 2*h*). This is a simplified depiction, in that typically several "clusters" of perforations 15 are stimulated with a single frac stage. Nonetheless, the general truth holds: horizontal wellbores are almost always completed in perforated then fracked intervals. Whether with the most common method of "plug-'n-perf", or with sliding sleeve systems, the creation of fracked intervals occurs from toe 4*d* to heel 4*b*, the net result being the entire frac "spread" (pump trucks, blenders, etc.) is on location . . . waiting for the next set of perfs or sleeves to be opened. before it can pump the next frac stage. For very long lateral sections 4*c*, this whole "24/7" process may take several consecutive days. The net effect has become the "wait time" between stages has become very expensive. Hence, for a CT or e-coil deployed system, the need to be able to complete wellbore lateral 4*c* in a single trip . . . or at least, very few trips . . . is essential.

Figure 1B:
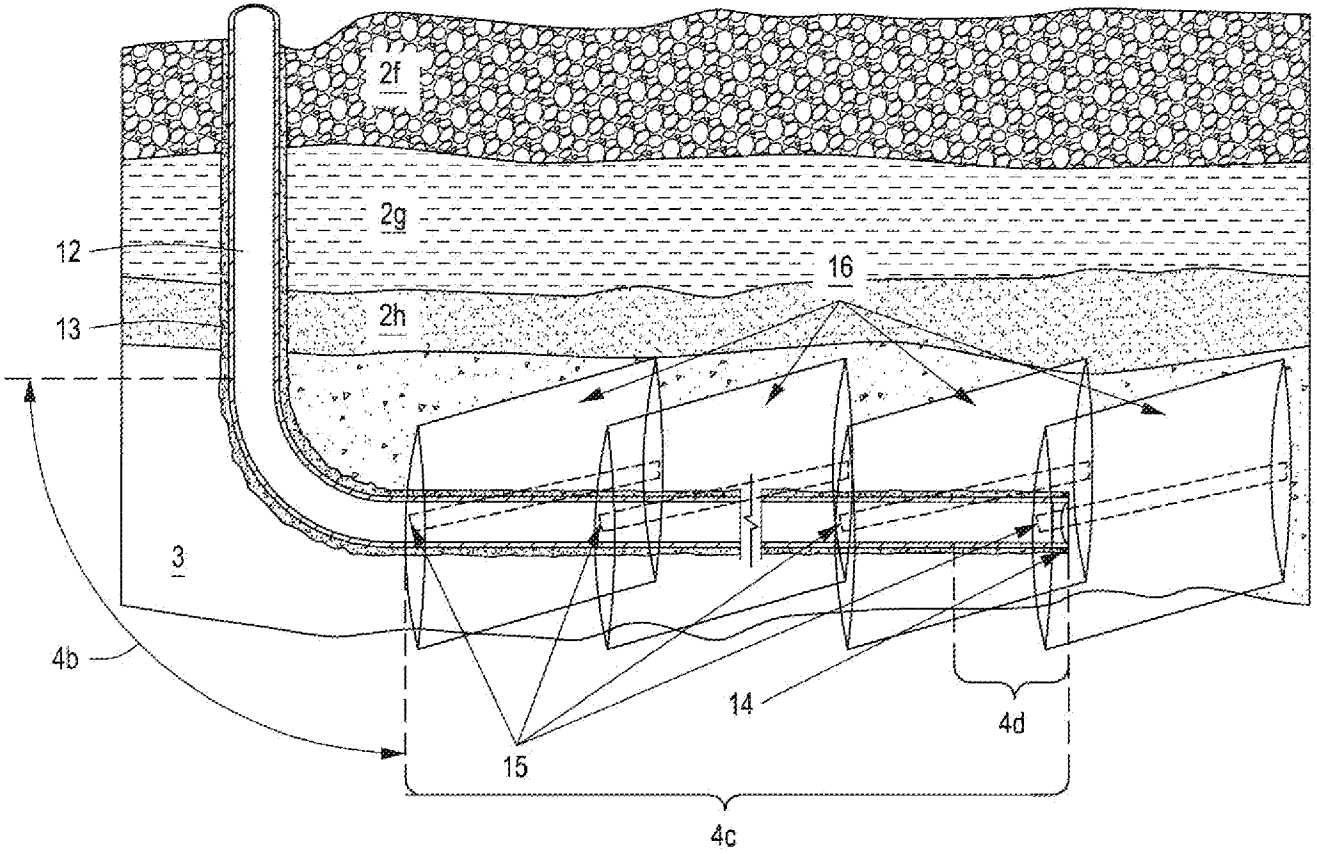
FIG. 1B provides another cross-sectional view of a horizontal wellbore, again cased and cemented, with the horizontal leg enlarged for clarity. Instead of receiving conventional perforations, Ultra Deep Perforations ("UDP's") were placed instead. The subsequent frac stages (only half-wings are shown) emanating from the entire length of UDP's are thus better constrained within the pay zone.

FIG. 1B is another enlarged, half-section view of wellbore 4, and particularly of lateral section 4*c*, but with one important difference: Note the up-and-down casing perforations 15 in FIG. 1A have now been replaced by the long, horizontal dashed lines 15 of FIG. 18 depicting "ultra deep perforations", or "UDP's". These mini-lateral boreholes, generally greater than 1 inch but less than 2.5 inches in diameter. may be jetted to lengths of several hundred feet. For simplicity, each pair of 180° opposing UDP's correlates to a single frac stage and thus, when rendered in half-section, yield each UDP 15 correlating to a single fracture half-wing 16. (in reality, UDP's could be isolated and fracked in "clusters", like perfs or sleeves.) Note the net result is that the fracture half-wings 16 in FIG. 1B are longer and better confined to the pay zone 3 than they are when emanating from the conventional perforations 15 in FIG. 1A. The method of generating the UDP's (15 in FIG. 1B) with an e-coil conveyed hydraulic jetting tool assembly, and doing so in a single trip in and out of wellbore 4, is presented in the above-referenced U.S. Pat. No. 9,976,351.

This assembly allows an operator to run a jetting hose into the horizontal section 4*c* of a wellbore 4, and then deploy the jetting hose out of a tubular jetting hose carrier using hydraulic and/or mechanical forces. Beneficially, as depicted in FIG. 2A, the jetting hose 1595 is extruded out of the jetting hose carrier (not shown) and against the concave face 1050.1 of a curvilinear "ramp" member 1050 of whipstock 1000. After locating the jetting nozzle 1600 opposite the position within production casing 12 where placement of a casing exit "W" is desired, jetting fluids . . . or more preferably at this point, a jetting slurry containing an abrasive . . . may be injected through the jetting hose 1595 and a connected nozzle 1600. A mini-lateral borehole (or UDP) may then be formed though the production casing 12, through the adjoining cement sheath 13, and extending from the wellbore 4 on out into pay zone 3. Note also the trajectory of the UDP emanating from the wellbore 4 depicted in FIG. 2A would be essentially orthogonal to the longitudinal axis of wellbore 4, as the arcuate face 1050.1 of ramp 1050 receives the jetting nozzle 1600 and jetting hose 1595 and turns them at or approximately 90°. Of special significance in FIG. 2A is that the whipstock 1000, ramp 1050, and arcuate face 1050.1 are configured to receive the jetting nozzle 1600 and jetting hose 1595 to form this 90° bend by utilizing the entire I.D. of production casing 12. Thus, the external bend radius "R" of jetting hose 1595 is exactly equal to the I.D. of production casing 12.

FIGS. 2B and 2B.1. depict a modified whipstock device 3000, such that it can mateably attach to and manipulate the inner sleeve 4200 of a Custom Ported Casing Collar ("CPCC") 4000, as disclosed in US2019013391, which is incorporated herein by reference. Note particularly in the enlarged insert FIG. 2B.1 the arcuate faces of the port 4210.S of the inner sleeve 4200 and the port 4110.W of outer sleeve 4100. When modified whipstock 3000 manipulates inner sleeve 4200 to bring these ports 4210.S and 4110.W into alignment, and because of the cavity 3100 in the whipstock 3000's body will provide for contact of jetting hose 1595 (not shown) with the I.D. of inner sleeve 4200, then the external bend radius "R" is actually extended to "R'". Accordingly, assuming it is again a 90° bending to the jetting hose 1595 that is desired, this full 90° turn does not have to be entirely accomplished along arcuate face 3001 within the body of whipstock 3000. Instead, arcuate port faces 4210.S and 4110.W essentially align to append that of 3001 in whipstock 3000, such that the 90° turn is accomplished upon the jetting nozzle 1600 (not shown) exiting the CPCC 4000, not upon its exit of modified whipstock 3000. Notwithstanding, because like production casing 12's thicknesses are usually in fractions of an inch, so too will be the thicknesses of inner sleeve 4200 and outer sleeve 4100. Hence, unless a particular jetting hoses 1595 has a minimum bend radius ("MBR") constraint that is not satisfied by the actual bend radius (R—hose O.D.) but is satisfied by (R'—hose O.D.), the above-described alignment of whipstock and CPCC ports will not have a direct bearing on sizing options for the jetting hose. The benefit, however, of not having to jet a casing exit W for every UDP, and to be able to selectively open or close specific ports/UDP's, makes the CPCC's 4000's placement within the production casing string 12 very advantageous.

Because the relative difference in actual bend radius provided by R' versus R may be inconsequential in providing jetting hose upsizing options, as discussed above. FIGS. 3A thru 3D, 4, and 5 have all been drawn to scale for the smallest production casing size commonly used for U.S. onshore wells, 4.5 inch O.D. These Figures all presume that the desired orientation of the UDP is generally perpendicular to the longitudinal axis of the host wellbore, and because they are to scale, are illustrative of the magnitude of the gain in external, and thus actual bend radius for a jetting hose. In each of these Figures, whereby a best case scenario for constructing the 90° hose bend entirely within the casing would be to gain the entire 4.0" casing I.D. for the external bend radius R (as in FIG. 2A). a telescoping sleeve enclosing an approximate 45° bend in itself is deployed to yield an extended external bend radius "R'" of 7.0 inches. Hence, this single-segment telescoping sleeve provides a 75% enlargement of the external bend radius in 4.0 inch I.D. (4.5" O.D.) production casing.

Before describing these 3-series Figures, note the above-description of "single-segment telescoping sleeve". A two-segment sleeve is depicted in Figure SB. To avoid complexity, however, only the simplest single-segment case has been presented in the other drawings. As depicted in Figure SB, a sleeve may be comprised of two or more segments, an outer segment 3900 and an inner segment 3950. Again, for a 90° hose bend, a two-segment construction could provide an approximate 30° bend within the body of the whipstock, housing two telescopic segments of like 30° bend, the sum of the three providing the requisite 90° turn. Similarly, three 22.5° telescopic segments could be housed within a whipstock body housing a like bending channel, and so on. Of interest is that the more segments provided, the less bend is required and thus a given whipstock diameter could accommodate a longer segment(s). Notwithstanding, as the number of telescopic segments increases. the concentricity of the segments requires an increasing hose channel diameter within the whipstock to house them.

Similarly, a simple biasing mechanism to extend the sleeve is shown in 3980, FIG. 5E. Additional biasing mechanisms to either extend or retract the sleeve are not provided though these could easily be added by those who are skilled in the art. Note that there is a significant downwards force on the jetting hose as it is deployed from the jetting hose carrier system defined in U.S. Pat. No. 9,976,351, which like the jetting hose channel in the extendible whipstock and the sleeve itself as shown in FIGS. 3A thru 3D, 4, and 5, has relatively close tolerances to the O.D. of the jetting hose itself. Thus, the sizing of the I.D.'s housing and guiding the jetting hose within this patented system are only slightly larger than the jetting hose O.D., so as to prevent jetting hose buckling as the hose is deployed. Hence, the frictional force of the jetting hose against the sleeve should be more than ample to extend and retract the sleeve from the whipstock with the correlative movement of the jetting hose. If necessary, those skilled in the art would know to add bearings (3981, FIG. 5J) between the outer surface of the sleeve and the channel it resides in within the whipstock body, thus ensuring the correlative movement.

Thus, as shown in FIGS. 3A thru 3D, 4, and 5, by means of the pressurized jetting hose extruding distally out of the jetting hose carrier (not shown) and circumferentially against the sleeve within the extendible whipstock, and the frictional forces thereby generated between the outer surface of the hose and the concave surface of the sleeve, the method utilizes the deployment of a whipstock bend radius extension that allows the jetting hose assembly to follow a larger bending radius (or, less severe bend) than could otherwise be supplied by a whipstock itself. This is because the maximum external bend radius that could be supplied by any whipstock 1000 or ramp mechanism 1056 (as shown in FIG. 2A) is limited to the I.D. of the casing 12 itself (or in the case of an open hole application, the I.D. of the borehole). Similarly, the maximum external bend radius that could be supplied by a modified whipstock 3000 that aligns with ports 4210.S and 4110.W (FIG. 2B) in a sleeve system is the sum of the thicknesses of the inner 4200 and outer 4100 sleeves as they append the inner sleeve's I.D. and bend radius R to form R'. The reader should bear in mind the telescoping sleeve system that will be presented in the forthcoming discussion of FIGS. 3A thru 3D, 4, and 5 has no such limitations.

FIG. 3A shows a conventional jetting hose whipstock 3000 equipped with a telescoping sleeve system 3900. At this point, the jetting hose 1595 and jetting nozzle 1600 are intentionally not shown for purposes of describing the extendible whipstock 3900 more clearly. However, as this FIG. 3 series is drawn to scale, the relative 1.20 inch outer diameter for this specific 0.75 inch I.D. jetting hose can be seen at 3001D.JH-$O_{1.20}$. The telescoping sleeve 3900 has been sized accordingly, with its 1.40 inch I.D. shown at 3001D.WE-$I_{1.40}$ and its 1.60 inch O.D. shown at 3001D.WE-$O_{1.60}$. The 0.20 inch difference in the O.D. of the jetting hose 1595 and the I.D. of the sleeve ensures sufficient clearance for the jetting hose to travel through the sleeve (with some pushing or pulling force exerted on the hose), but a tight enough clearance to both: (a) preclude the jetting hose from buckling within the sleeve; and, (b) insure ample contact area between the hose and the sleeve to provide plenty of frictional force to translate the sleeve with correlative movement of the hose.

Though for example purposes only, this specific single-sleeve extendible whipstock sleeve 3900 configuration depicted in FIG. 3A is housed within a whipstock 3000 body having an O.D. of 3.5 inches, shown at 3001D.Wh-$O_{3.50}$, which might approach the maximum O.D. of a rigid body that an operator would want to translate in and out of a standard 4.5 inch O.D. (shown at 3001D.Csg-$O_{4.5}$) production casing 12 with an I.D. approximating 4.0 inches (shown at 3001D.Csg-$I_{4.0}$). Note the sleeve 3900 is being shown in both its retrieved 3900.R and extended 3900.E positions. Obviously, it could not exist in both positions at the same time as shown in FIG. 3A. Nonetheless, the depiction in FIG. 3A is helpful to explain: (1) the degree of travel required for the sleeve 3900 to start at its retrieved 3900.R position and fully extend to its 3900.E position; and, (2) the precise path of travel between its retrieved 3900.R and fully extended 3900.E positions.

As shown in FIGS. 3 through 5, the degree, or limits of travel of the sleeve 3900 are precisely defined. First, the travel of sleeve 3900 is limited proximally by an upper stop ring 3910 embedded in the jetting hose channel of the whipstock body 3000 itself. When the upper surface of the sleeve's upset shoulder stop 3930 engages the lower surface of whipstock's 3000's upper stop ring 3910, the sleeve 3900 can travel no farther proximally. Similarly, when the lower surface of the sleeve's upset shoulder stop 3930 engages the upper surface of the whipstock's 3000's lower stop ring 3920, the sleeve 3900 can travel no farther distally. Notwithstanding, sufficient frictional force between the inner surface of the sleeve 3900 and the jetting hose 1595 (when the jetting hose is being either advanced distally or retracted proximally) will provide for free and correlative movement of the sleeve 3900 between these two positions 3900.R and 3900.E. As shown in Figure SE, a spring 3980 or other biasing mechanisms could be added to help facilitate positional translation of the sleeve. FIG. 5E also depicts the addition of friction-reducing coatings 3970.A applied to the inner surface of the whipstock 3905 and/or the outer surface of the sleeve 3900. Similarly depicted in Figure SE is the application of an abrasion and/or erosion resistant coating 3970.B to the outer surface of the sleeve 3900 to protect the sleeve from jetting slurry abrasives, formation fines, etc. Likewise, a lubricity-adding surface treatment 3970.C could be applied to the inner surface of the whipstock 3905 and the outer surface of the sleeve 3900, as can be seen by someone skilled in the art in FIG. 5E.

In order to allow flushing of the FIG. 5G sleeve 3901 and thereby avoid interference in sleeve 3901 travel caused by jetting slurry abrasives, formation fines and other debris, slots 3916 can be added to the sleeve 3901.

To facilitate entry into the jetted holes in the casing, cement sheath and formation, especially in cases where the jetted holes may be irregularly shaped, the FIG. 5H sleeve 3902 has been modified to create a scoop/shoehorn profile. The semi-circular cross-section of the distal end of the sleeve enables the sleeve to more readily follow the jetting assembly through the jetted hole in the casing. cement sheath, and/or formation while still providing the support structure necessary to guide the jetting assembly.

FIG. 3A also depicts the circular paths of travel for the arc surfaces of the extendible whipstock 3900. Note that the inner wall 3000 of the outermost surface of the sleeve 3900 defines an external bend radius for the jetting hose, R". This radius R", which for this example sleeve configuration is precisely 7.2 inches, defines a circle having as its center the point 3999. Note this is a common center point for all of the (two dimensional) arcuate surfaces of the sleeve 3900. Accordingly, if a jetting hose having a 1.20 inch O.D. (shown at 3001D.JH-$O_{1.20}$) were precisely centered in the sleeve 3900, then it would have an external bend radius approximating 7 inches (shown at 3001R.JH-$BRe_{7.0}$) and an actual bend radius approximating 5.8 inches (shown at 3001R.JH-$BR_{5.8}$). Because this specific jetting hose has a minimum bend radius ("MBR") of 4.75 inches (shown at 3001R.JH-$MBR_{4.75}$), it is observed that the sleeve has provided for utilization of a jetting hose 1595 having an MBR that is actually greater that both the I.D. and O.D. of the casing. This could never be accomplished with any conventional or even modified (for CPCC use) jetting hose whipstock apparatus Perhaps the above can best be observed from the FIG. 3A example of a 90° bend of the jetting hose by noting the position of the distal end of the sleeve 3900 when fully extended at 3900.E. Specifically, the end of sleeve 3900 has transgressed both the O.D. of the 4.5 inch casing 12, the cement sheath 13, and the wall of the 7.875 inch borehole (diameter shown at 3001D.bh-$I_{7.875}$ . . . a common borehole size used to accommodate 4.5 inch casing 12), to extend several inches into the pay zone 3.

Like FIG. 3A. FIG. 3B also provides a cross-sectional view of the whipstock device 3000 positioned in a horizontal position and rotated 90° about the horizontal axis. Specifically, FIG. 38 depicts the telescoping sleeve 3900 in the fully retracted (proximal) position 3900.R (only), but unlike FIG. 3A, FIG. 3B also includes the commensurate (retrieved) positions of the jetting hose 1595 and the jetting nozzle 1600. Note that this 3900.R position of the sleeve 3900 occurs when the jetting assembly (i.e., the jetting hose 1595 and jetting nozzle 1600) is fully retrieved back into the whipstock 3000 of the hydraulic jetting tool string. Particularly, this would be the case for the hydraulic jetting tool string presented in U.S. Pat. No. 9,976,351.

This fully retracted position 3900.R of the sleeve 3900 should occur due to frictional forces of the jetting hose 1595 as it is retrieved back into the jetting hose carrier of the jetting assembly . . . perhaps with the retrieval of no more length of jetting hose 1595 than that of the arc length of the I.D. of sleeve 3900. Notwithstanding. in that the 1.6 inch O.D. of the sleeve 3900 (shown at 3001D.WE-$O_{1.60}$) is also the approximate O.D. of the jetting nozzle 1600, the proximal edge of the jetting nozzle 1600 will shoulder the distal end of the sleeve 3900 as the jetting hose 1595 is retrieved back into the jetting hose carrier sub-assembly of the hydraulic jetting apparatus. Thus, if the fully retracted 3900.R position of the sleeve 3900 is not achieved from frictional forces of jetting hose 1595 retrieval, then full retraction 3900.R of the sleeve 3900 must occur from mechanical forces, such as when the distal end of the sleeve 3900 engages the proximal end of the jetting nozzle 1600. Note that when the sleeve's upset shoulder stop 3930 contacts the whipstock's 3000's upper stop ring 3910, the sleeve 3900 can thus be retrieved proximally no further than position 3930.R. Inclusion of a tensiometer, and/or contact sensors, in the hydraulic jetting tool assembly will prevent over-pull of jetting hose 1595 once the upset shoulder stop 3930 of sleeve 3900 has contacted upper stop ring 3910 of whipstock 3000, thus precluding damage to the sleeve 3900, whipstock 3000, jetting hose 1595, or the jetting hose connection to jetting nozzle 1600.

FIG. 3C is another cross-sectional view of whipstock apparatus 3000 with the telescoping sleeve 3900 in its fully extended position 3900.E. It should be emphasized that FIG. 3C probably depicts the most critical part of the process employing the sleeve 3900. That is, first, as the casing 12 exit "W" was formed, the casing exit had to be of sufficient diameter such that both the jetting nozzle 1600 and the sleeve 3900 could pass through it. Here we see the reasoning for making the O.D. of sleeve 3900 no greater than the O.D. of jetting nozzle 1600. This precludes a configuration where the nozzle 1600 could pass through casing exit W, but not the sleeve 3900, which would leave the UDP to continue forming at an angle significantly less than the desired orthogonal orientation to the host wellbore 4.

Subsequent to penetration of casing 12. the sleeve continues to guide the jetting nozzle 1600 and jetting hose 1595 to "build angle" towards the desired orthogonal UDP orientation while jetting through the cement sheath 13. Note there is more than just a remote chance that, particularly in a horizontal well 4 completion, cement 13 was not completely circulated and established consistently around casing 12 as shown, and that only an annulus filled with drilling mud exists in a particular portion of the wellbore opposite casing exit W. Here, the sleeve 3900 provides the invaluable function of stabilizing the jetting assembly, such that it does not allow this early part of UDP formation to occur outside its predetermined arcuate course. Perhaps even more valuable, the sleeve in this instance is precluding a destabilized jetting of such a tortuous path that, if the liquid filled annulus between casing 12 and pay zone 3 were large enough, misalignment could damage the jetting hose 1595. and/or the jetting nozzle 1600 could not be retrieved back through casing exit W.

Subsequent to guiding the UDP through cement 13 (or liquid annulus), the sleeve reaches its fully extended position 3900.E as the jetting assembly has penetrated into the pay zone 3, where the distal edge of the sleeve has 'followed' the proximal edge of the jetting nozzle 1600 to the sleeve's fully extended position 3900.E, and the sleeve's 3900's Upset Shoulder Stop 3930 is now contacting the whipstock's 3000's Lower Stop Ring 3920 at 3930.E, 3900.E. Thus, FIG. 3C depicts the instant at which the proximal edge of the jetting nozzle 1600 is about to disengage from the distal end of the sleeve 3900. As noted above, this "following" function is so critical to the guidance of the jetting assembly, a biasing mechanism . . . for example (shown in FIG. 5E), exerting a significant spring force driving the sleeve 3900 distally . . . may be perceived by many skilled in the art as an essential addition here. Further enhancement would be to utilize, for example magnetic sensors (shown in FIG. 5C), such that the operator at surface would know the exact time, and length of jetting hose deployed, at which the jetting nozzle 1600 disengaged the sleeve 3900. Of course, additional sensors could be added to know when the sleeve 3900's upset shoulder stop 3930 contacted either upper stop ring 3910 or lower stop ring 3920. Note in the case of the latter, it should occur only slightly before a sensor were to signal the disengagement of nozzle 1600 from the distal end of sleeve 3900.

FIG. 3D is the same cross-sectional view as FIG. 3C, but with continued jetting of the UDP laterally away (approximately perpendicular to) the host wellbore 4. Obviously, with continued jetting the proximal edge of the jetting nozzle 1600 has long since pulled away from the distal edge of the sleeve 3900, yet the sleeve remains in its same, furthest extended (distal) position 3900.E; i.e. where 3930.E is contacting 3920 as in FIG. 3C, due to frictional forces of the jetting hose 1600 advancing distally through it.

It should be observed here that as seen in FIG. 1B, the orthogonal orientation of the UDP 15 from wellbore 4, though perhaps the most desired orientation by a majority of operators, is for illustrative purposes only. Obviously, the sleeve 3900 length could be constructed such that UDP angles of other than 90° from host wellbore 4 were achieved. Further, the apparatus could easily be mechanized. One example of such mechanization is depicted in FIG. 5F, with the addition of sensors 3960, a splined sleeve 3985, a reversible servo motor 3990 and a mating spline gear 3995. By using a servo-type motor and gear-driven sleeve as shown in FIG. 5F, those skilled in the art such could adjust the angle of departure of the UDP 15 from wellbore 4 such that it could be variably selected for each UDP, within some feasible range. This capability could prove invaluable if, for example, an operator wanted to jet UDP's along the plane of maximum principle stress of pay zone 3, but the lateral section 4*c* of wellbore 4 was drilled at some angle other than parallel to the plane of least principle stress of pay zone 3. Suppose this desired intersection were off by 10°. In this case, with a variable length sleeve and the capability to select its range of extension as in FIG. 5F, one UDP could be jetted into pay zone three at an orientation of 80°, the whipstock rotated, then the opposite UDP jetted at an angle of 100°. Otherwise, if this were the case for the entire completion of lateral section 4*c*, all of the 80° would have to be jetted first, the bottom hole assembly and CT string retrieved to surface, and the sleeve changed out to a 110° length, re-run, and all of the 110° UDP's jetted. Note this would preclude annular fracs for all but the last stage . . . hence the value of a variable length deployable sleeve 3985, as shown in FIG. 5F.

FIG. 4 is an overlay of: (1) a conventional whipstock such as 1000 in FIG. 2A or 3000 in FIG. 2B, where the whipstock provides an external bend radius R of 4.0 inches exactly equal to the casing I.D.; superimposed upon, (2) another whipstock 3000, but one equipped with a sleeve as depicted in both its fully retracted 3900.R and fully extended 3900.E positions (as in FIG. 3A), thus providing an external bend radius 3001R.JH-BR$e_{7.0}$, or R" of 7.0 inches, thereby yielding an actual bend radius 3001R.JH-BR$_{5.8}$ of 5.8 inches. Note because this real-life example of this ¾-inch I.D., 1.2 inch O.D. high pressure jetting hose has a minimum bend radius ("MBR") 3001R.JH-MBR$_{4.75}$ of 4.75 inches, it could not have been utilized in this application without the sleeve. Note the bend radius provided for this hose inside the 4.5-inch production casing 12 would have only been [(R=4.0 inches)−(Hose O.D.=1.2 inches)]=2.8 inches . . . significantly and prohibitively less than the MBR=4.75 inches.

Note that FIG. 5 is the same depiction as FIG. 3A, again to an approximate 2.5:1 scale, except with an added background of to-scale depictions of the next three standard oilfield casing 12 sizes; e.g., O.D.'s of 5.0, 5.5, and 7.0 inches. Note that if a conventional whipstock 1000 or 3000 utilizing the entire I.D. each of these casings (even using average weights, I.D.'s=4.408", 4.892", and 6.366", respectively) were applied to the same 1.20" O.D. jetting hose, then the actual bend radii's provided would be 3.208", 3.692", and 5.166", respectively. That is, only the 7.0"-O.D. casing could accommodate the 4.75" MBR of this jetting hose without a telescoping sleeve. Of course, with a telescoping sleeve also applied in the 7.0" casing, a jetting hose of an even larger MBR could be utilized.

Lastly, FIG. 5A is the same depiction as FIG. 5, again to an approximate 2.5:1 scale, with the same background of to-scale depictions of the next three standard oilfield casing 12 sizes (O.D.'s of 5.0, 5.5, and 7.0 inches). However, instead of all casing and hole sizes being aligned on a common centerline, all of the casings have been aligned on a common (LHS) edge. (The 8&¾$^{ths}$-inch hole diameter remains centered upon the 7-inch O.D. casing: e.g., the only casing size that would require it.) This depiction is beneficial in that it illustrates the same extendible whipstock apparatus could be used for all four casing sizes. In fact, as shown, the distal end of the telescoping sleeve in its fully extended position would only lack about a quarter of an inch of penetrating not only the entire 7.0-inch casing, but also the entire cement sheath in a gauge 8¾-inch hole. Certainly with the added width of the abutted jetting nozzle 1600 (not shown), the sleeve would be placing the jetting nozzle into the formation pay 3 before it disengages the distal end of the sleeve . . . that is, assuming 7-inch casing is centered in the 8¾ inch hole. Notwithstanding, in an average weight (23#/ft) 7-inch casing having a 6.366-inch I.D., a conventional whipstock could provide a bend radius of 5.166 inches . . . certainly enough to satisfy the 4.75-inch MBR of the subject hose. Hence, the deliberation becomes one of configuring a telescoping sleeve for a whipstock body . . . instead of the presented 3.5-inch O.D . . . of approximately 5-inch O.D. Even a single-segment configuration for an upsized 5-inch whipstock body will lead to optimization calculations for at least a ⅞$^{ths}$ I.D. jetting hose . . . if not a 1.0" I.D. . . . certainly in the realm of smaller I.D. coiled tubing strings. Note the latter would require an approximate 2.0-inch UDP diameter . . . hence the optimization exercise of the benefit of additional HHP at the jetting nozzle versus an increasing excavation requirement, as illustrated in FIG. 10, which suggests increasing from 3.8 $ft^3$ (for a 300 feet long, 1.5-inch diameter UDP) to approximately 6.5 $ft^3$ (300 feet long, 2.0-inch diameter UDP) . . . about a 70% increase in excavated rock volume. From FIG. 8, even at a pump rate as high as of 2 BPM, the 0.75-inch I.D. hose only reflects losses of 2,000 psi and 200 HHP . . . or only 13% of a 15 k psi RHJ pressure system limit . . . making the 70% excavation increase a difficult proposition, indeed.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art. Such changes and modifications are encompassed within this invention as defined by the claims

What is claimed is:

1. An apparatus for increasing a downhole bend radius of an arcuate bending path for a flexible conduit comprising:

a whipstock body having a curved inner channel inside the whipstock body and an exit portal of the curved inner channel, at least a portion of the curved inner channel defining a proximal portion, inside the whipstock body, of the arcuate bending path for the flexible conduit, the proximal portion of the arcuate bending path having a distal end at the exit portal of the whipstock body, and the proximal portion of the arcuate bending path having a curvilinear length inside the whipstock body and a curvature;

an arced extension for the arcuate bending path for the flexible conduit;

the arced extension being retractable through the exit portal of the whipstock body to a fully retracted position in the curved inner channel in which both a proximal end and a distal end of the arced extension are positioned in the curved inner channel of the whipstock body;

the arced extension being extendible through the exit portal of the whipstock body from the fully retracted position of the arced extension in the curved inner channel of the whipstock body to a fully extended position;

when the arced extension is partially extended or in the fully extended position, a distal portion of the arced extension which projects from the exit portal outside of the whipstock body defines a distal portion of the arcuate bending path for the flexible conduit;

when the arced extension is partially extended or in the fully extended position, the proximal end of the arced extension is positioned in the curved inner channel of the whipstock body;

the arced extension having a curvature which corresponds to the curvature of the proximal portion of the arcuate bending path and the arced extension having a curvilinear length when in the fully retracted position which is less than or equal to the curvilinear length of the proximal portion of the arcuate bending path so that, when retracted to the fully retracted position, the arced extension is fully received in the proximal portion of the arcuate bending path in the whipstock body; and the proximal portion of the arcuate bending path guides the arced extension along the arcuate bending path as the arced extension is extended from the fully retracted position to the fully extended position.

2. The apparatus of claim 1 wherein:

the arced extension includes a stop structure;

the stop structure of the arced extension abuts a retraction stop structure within the whipstock body when the arced extension is fully retracted; and the stop structure of the arced extension abuts an extension stop structure within the whipstock body when the arced extension is fully extended.

3. The apparatus of claim 1 wherein the arced extension is formed of a single, arcuate sleeve segment and the curvilinear length of the arced extension when in the fully retracted position is equal to a curvilinear length of the arced extension when in the fully extended position.

4. The apparatus of claim 1 wherein, when the arced extension is fully extended, the arcuate bending path for the flexible conduit formed by the proximal portion of the arcuate bending path inside the whipstock body and the arced extension is an arc in a range of from 70° to 110°.

5. The apparatus of claim 1 wherein, when the arced extension is fully extended, the arcuate bending path for the flexible conduit formed by the proximal portion of the arcuate bending path inside the whipstock body and the arced extension is an arc of about 90°.

6. The apparatus of claim 1 wherein the arced extension comprises a plurality of telescoping arcuate sleeve segments and the curvilinear length of the arced extension when in the fully retracted position is less than a curvilinear length of the arced extension when in the fully extended position.

7. The apparatus of claim 1 further comprising a biasing element in the whipstock body which biases the arced extension outwardly toward its fully extended position.

8. The apparatus of claim 7 wherein the biasing element is a spring.

9. The apparatus of claim 1 further comprising a servo motor in the whipstock body which drives the arced extension outwardly to its fully extended position.

10. The apparatus of claim 9 wherein the servo motor is reversible to retract the arced extension.

11. The apparatus of claim 9 further comprising a ratchet mechanism through which the servo motor incrementally drives the arced extension outward.

12. The apparatus of claim 1 further comprising one or more latching devices in the whipstock body to releasably latch the arced extension in its fully extended and fully retracted positions.

13. An apparatus for forming a lateral borehole in a subsurface formation comprising:

a flexible conduit;

a whipstock body having a curved inner channel inside the whipstock body through which the flexible conduit slideably extends, at least a distal portion of the curved inner channel defining a proximal portion of an arcuate bending path for the flexible conduit;

an arced extension through which the flexible conduit slideably extends, the arced extension being (i) retractable to a fully retracted position in which a distal end of the arced extension is positioned within the curved inner channel of the whipstock body and (ii) extendible from the fully retracted position to a fully extended position in which a proximal end of the arced extension is positioned within the curved inner channel of the whipstock body and a distal portion of the arced extension, which is positioned outside of the whipstock body, defines a distal portion of the arcuate bending path for the flexible conduit; and an excavation device for excavating the lateral borehole in the subsurface formation along an excavation path of the excavation device, the excavation device being positioned on a distal end of the flexible conduit outside of the distal end of the arced extension such that the flexible conduit and the excavation device can extend outwardly from the distal end of the arced extension, the excavation device being sized to engage the distal end of the arced extension when the flexible conduit is withdrawn rearwardly through the arced extension such that, when the excavation device engages the distal end of the arced extension, the excavation device on the distal end of the flexible conduit is stopped from being withdrawn rearwardly through the arced extension, and the excavation path of the excavation device comprising (i) an initial arcuate excavation segment in which the arced extension travels with the excavation device from the fully retracted position to the fully extended position of the arced extension and guides the excavation device along the initial arcuate excavation segment so that the initial arcuate excavation segment has a curvature which corresponds to and which receives a curvature of the arced extension and (ii) a subsequent portion of the excavation path in which the excavation device and the flexible hose pull away from the distal end of the arced extension.

14. The apparatus of claim 13 wherein the flexible conduit is a flexible jetting hose and the excavation device is a jetting nozzle.

15. The apparatus of claim 13 wherein:

the arced extension includes a stop structure;

the stop structure of the arced extension abuts a retraction stop structure within the whipstock body when the arced extension is fully retracted; and the stop structure of the arced extension abuts an extension stop structure within the whipstock body when the arced extension is fully extended.

16. The apparatus of claim 13 wherein the flexible conduit frictionally engages the arced extension such that, when the flexible conduit and the excavation device are extended from the whipstock body along the excavation path of the excavation device, the flexible conduit carries the arced extension outwardly until the arced extension reaches its fully extended position.

17. The apparatus of claim 16 wherein, when the flexible conduit and the excavation device are retracted to the whipstock body, the flexible conduit carries the arced extension into the whipstock body by frictional contact until the arced extension reaches its fully retracted position.

18. The apparatus of claim 13 further comprising a well casing in which the whipstock body is positioned, wherein, in an initial portion of the initial arcuate excavation segment of the excavation path of the excavation device the arced extension travels with the excavation device as the excavation device bores through a wall of the casing.

19. The apparatus of claim 13 wherein the excavation device comprises a hydraulic motor and bit assembly.

20. The apparatus of claim 13 further comprising a custom ported casing collar having an inner sleeve to which the whipstock body is mateably attached for manipulating the inner sleeve to align a port of the inner sleeve with a port of an outer sleeve of the custom ported casing collar.

21. The apparatus of claim 13 wherein openings are provided through a wall of the arced extension which allow debris to pass from an interior to an exterior of the arced extension.

22. The apparatus of claim 13 further comprising an abrasion and erosion resistant coating on an exterior surface of the arced extension.

23. The apparatus of claim 13 further comprising a lubricity-enhancing and/or friction-reducing coating on an exterior surface of the arced extension and/or the curved inner channel of the whipstock body.

24. The apparatus of claim 13 further comprising bearings in the whipstock body which contact an outer surface of the arced extension.

25. The apparatus of claim 13 wherein the distal portion of the arced extension has a scoop shape.

26. A method of increasing a bend radius of an arcuate bending path of a flexible conduit when forming a lateral borehole in a subsurface formation, the method comprising the steps of:

a) positioning an excavating assembly for the lateral borehole in a cased or non-cased main borehole which extends into and/or through the subsurface formation, the excavating assembly comprising a whipstock body having a curved inner channel inside the whipstock body through which the flexible conduit slideably extends, at least a distal portion of the curved inner channel defining a proximal portion of the arcuate bending path for the flexible conduit, an arced extension through which the flexible conduit slideably extends, the arced extension being in a retracted position in step (a) in which a distal end of the arced extension is positioned within the curved inner channel of the whipstock body, and the arced extension being extendable from the retracted position of the arced extension to an extended position in which a proximal end of the arced extension is positioned in the curved inner channel of the whipstock body and a distal portion of the arced extension is positioned outside of the whipstock body and defines a distal portion of the arcuate bending path for the flexible conduit, and an excavation device positioned on a distal end of the flexible conduit outside of the distal end of the arced extension, the excavation device being in a retracted position in step (a) in which the excavation device is positioned in the main borehole, and the excavation device being sized to engage the distal end of the arced extension when the flexible conduit is withdrawn rearwardly through the arced extension such that, when the excavation device is in the retracted position of the excavation device, the excavation device is in engagement with the distal end of the arced extension and is stopped from being withdrawn rearwardly through the arced extension;

b) extending the excavation device and the flexible conduit from the whipstock body along an initial arcuate segment of an excavation path of the excavation device into the subsurface formation in which the arced extension travels with the excavation device from the retracted position of the arced extension to the extended position of the arced extension and guides the excavation device along the initial arcuate excavation segment so that the initial arcuate excavation segment which is excavated by the excavation device has a curvature which corresponds to and receives a curvature of the arced extension; and c) after a fully extended position of the arced extension is reached, extending the excavation device and the flexible conduit from the distal end of the arced extension along a subsequent portion of the excavation path of the excavation device into the subsurface formation to form the lateral borehole.

27. The method of claim 26 wherein, in step (c), the excavation device and the flexible conduit are extended from the distal end of the arced extension into the subsurface formation along a linear trajectory.

28. The method of claim 26 wherein:

the arced extension has a stop structure;

the stop structure of the arced extension abuts a retraction stop structure within the whipstock body when the arced extension is in a fully retracted position; and the stop structure of the arcuate extension abuts an extension stop structure within the whipstock body in step (b) when the arced extension reaches the fully extended position of the arced extension.

29. The method of claim 26 wherein the arced extension is formed of a single, arcuate sleeve segment and a curvilinear length of the arced extension when in the retracted position of the arced extension is equal to a curvilinear length of the arced extension when in the fully extended position.

30. The method of claim 26 wherein the arced extension is formed of a plurality of telescoping arcuate sleeve segments and a curvilinear length of the arced extension when in the retracted position of the arced extension is less than a curvilinear length of the arced extension when in the fully extended position.

31. The method of claim 26 wherein:

in step (b), the flexible conduit frictionally engages the arced extension as the excavation device and the flexible conduit are extended from the whipstock body such that the flexible conduit carries the arced extension to the fully extended position of the arced extension and in step (c), the flexible conduit slides through the arced extension as the excavation device and the flexible conduit are extended from the distal end of the arced extension into the subsurface formation.

32. The method of claim 26 further comprising the step, after step (c), of retracting the excavation device and the flexible conduit from the lateral borehole, wherein during the step of retracting, the flexible conduit slides through the arced extension until the excavation device engages the distal end of the arced extension.

33. The method of claim 26 wherein;

the main borehole has a casing therein;

the excavating assembly is positioned in the casing in step (a); and in an initial portion of step (b), the arced extension guides the excavation device along an arced path as the excavation device cuts a hole through a wall of the casing and the distal end of the arced extension travels with the excavation device through said hole through the wall of the casing.

34. The method of claim 26 wherein the flexible conduit is a jetting hose and the excavation device is a jetting nozzle.

35. The method of claim 26 wherein the excavation device comprises a hydraulic motor and bit assembly.

36. The method of claim 26 wherein, when the arced extension is fully extended, the arcuate bending path for the flexible conduit formed by the curved inner channel of the whipstock body and the arced extension is an arc in a range of from 70° to 110°.

37. The method of claim 26 wherein, when the arced extension is fully extended, the arcuate bending path for the flexible conduit formed by the curved inner channel of the whipstock body and the arced extension is an arc of about 90°.

38. An apparatus for increasing a downhole bend radius of an arcuate bending path for a flexible conduit comprising:

a whipstock body having a curved inner channel which defines a proximal portion of the arcuate bending path for the flexible conduit;

an arced extension for the curved inner channel of the whipstock body;

the arced extension being retractable to a fully retracted position in which a distal end of the arced extension is positioned within the whipstock body;

the arced extension being extendible from the fully retracted position of the arced extension to a fully extended position;

when the arced extension is partially extended or in the fully extended position, the arced extension defines a distal portion of the arcuate bending path for the flexible conduit; and when the arced extension is in the fully extended position, a proximal end of the arced extension is positioned within the whipstock body and the distal end of the arced extension is positioned outside of the whipstock body, wherein the arced extension includes a stop structure, the stop structure of the arced extension abuts a retraction stop structure within the whipstock body when the arced extension is fully retracted, and the stop structure of the arced extension abuts an extension stop structure within the whipstock body when the arced extension is fully extended.

39. An apparatus for forming a lateral borehole in a subsurface formation comprising:

a whipstock body having a curved inner channel;

an arced extension of the curved inner channel of the whipstock body, the arced extension being (i) retractable to a fully retracted position in which a distal end of the arced extension is positioned within the whipstock body and (ii) extendible along a continuum from the fully retracted position to a fully extended position in which a proximal end of the arced extension is positioned within the whipstock body and the distal end of the arced extension is positioned outside of the whipstock body;

a flexible conduit which slidably extends through the curved inner channel of the whipstock body and through the arced extension; and an excavation device positioned on a distal end of the flexible conduit outside of the distal end of the arced extension, wherein the curved inner channel of the whipstock body and the arced extension, when partially or fully extended, form an arcuate bending path for the flexible conduit, and the flexible conduit frictionally engages the arced extension such that, when the flexible conduit and the excavation device are extended from the whipstock body, the flexible conduit carries the arced extension outwardly until the arced extension reaches its fully extended position.

40. The apparatus of claim 39 wherein, when the flexible conduit and the excavation device are retracted to the whipstock body, the flexible conduit carries the arced extension into the whipstock body by frictional contact until the arced extension reaches its fully retracted position.

41. A method of increasing a bend radius of an arcuate bending path of a flexible conduit when forming a lateral borehole in a subsurface formation, the method comprising the steps of:

(a) positioning an excavating assembly for the lateral borehole in a cased or non-cased main borehole which extends into and/or through the subsurface formation, the excavating assembly comprising a whipstock body having a curved inner channel, an arced extension of the curved inner channel of the whipstock body, the arced extension being in a retracted position in which a distal end of the arced extension is positioned within the whipstock body, the flexible conduit slidably extending through the curved inner channel of the whipstock body and through the arced extension, and an excavation device positioned on a distal end of the flexible conduit outside of the distal end of the arced extension, the excavation device being in a retracted position in which the excavation device is positioned in the main borehole;

(b) extending the excavation device and the flexible conduit from the whipstock body, and initially extending the arced extension from the whipstock body with the excavation device and the flexible conduit so that the curved inner channel of the whipstock body and the arced extension form the arcuate bending path for the flexible conduit, wherein the arced extension is extended with the excavation device and the flexible conduit until a fully extended position of the arced extension is reached in which the arced extension extends into a cased or non-cased wall of the main borehole;

(c) after the fully extended position of the arced extension is reached, extending the excavating device and the flexible conduit from the distal end of the arced extension into the subsurface formation to form the lateral borehole; and (d) after step (c), retracting the excavation device and the flexible conduit from the lateral borehole, wherein during the step of retracting, the flexible conduit slides through the arced extension until the excavation device engages the distal end of the arced extension.

* * * * *